US008955619B2

(12) United States Patent
Tilton et al.

(10) Patent No.: US 8,955,619 B2
(45) Date of Patent: Feb. 17, 2015

(54) MANAGED PRESSURE DRILLING

(75) Inventors: Frederick T. Tilton, Spring, TX (US); David M. Haugen, League City, TX (US); Kevin W. Smith, Houston, TX (US); David J. Brunnert, Cypress, TX (US); Thomas F. Bailey, Houston, TX (US); Tom Fuller, Aberdeenshire (GB); Roy W. Rooyakkers, Tananger (NO); Ram K. Bansal, Houston, TX (US); Graham Skinner, Aberdeenshire (GB)

(73) Assignee: Weatherford/Lamb, Inc., Houston, TX (US)

( * ) Notice: Subject to any disclaimer, the term of this patent is extended or adjusted under 35 U.S.C. 154(b) by 552 days.

(21) Appl. No.: 11/254,993

(22) Filed: Oct. 20, 2005

(65) Prior Publication Data

US 2006/0157282 A1 Jul. 20, 2006

(51) Int. Cl.

| | |
|---|---|
| ***E21B 21/08*** | (2006.01) |
| ***E21B 4/02*** | (2006.01) |
| ***E21B 21/00*** | (2006.01) |
| ***E21B 21/14*** | (2006.01) |
| ***E21B 33/14*** | (2006.01) |

(52) U.S. Cl.

CPC . *E21B 21/08* (2013.01); *E21B 4/02* (2013.01); *E21B 21/00* (2013.01); *E21B 21/14* (2013.01); *E21B 33/14* (2013.01); *E21B 2021/006* (2013.01)

USPC ..... 175/25; 175/38; 175/48

(58) Field of Classification Search

USPC ..... 175/25, 48, 38

See application file for complete search history.

(56) References Cited

U.S. PATENT DOCUMENTS

| | | | |
|---|---|---|---|
| 2,290,408 | A | 7/1942 | Crites |
| 3,362,487 | A | 1/1968 | Lindsey |
| 3,517,553 | A | 6/1970 | Williams |
| 3,552,502 | A | 1/1971 | Wilson, Sr. |
| 4,247,312 | A | 1/1981 | Thakur et al. |
| 4,297,880 | A | 11/1981 | Berger |
| 4,440,239 | A | 4/1984 | Evans |
| 4,630,675 | A | 12/1986 | Neipling et al. |
| 4,771,675 | A | 9/1988 | Grauer et al. |
| 5,010,966 | A | 4/1991 | Stokley et al. |
| 5,154,078 | A | 10/1992 | Codazzi |
| 5,661,402 | A | 8/1997 | Chesnutt et al. |

(Continued)

FOREIGN PATENT DOCUMENTS

| | | |
|---|---|---|
| CA | 2477242 | 8/2003 |
| EP | 1375817 | 1/2004 |

(Continued)

OTHER PUBLICATIONS

Properties of Foam (date unknown).

(Continued)

*Primary Examiner* — Brad Harcourt

(74) *Attorney, Agent, or Firm* — Patterson & Sheridan, L.L.P.

(57) ABSTRACT

Embodiments of the present invention include methods and apparatus for dynamically controlling pressure within a wellbore while forming the wellbore. In one aspect, one or more pressure control apparatus are used to maintain desired pressure within the wellbore while drilling the wellbore. In another aspect, pressure is dynamically controlled while drilling using foam to maintain a substantially homogenous foam flow regime within the wellbore annulus for carrying cuttings from the wellbore.

8 Claims, 19 Drawing Sheets

(56) References Cited

U.S. PATENT DOCUMENTS

| | | | | |
|---|---|---|---|---|
| 5,716,910 | A | 2/1998 | Totten et al. | |
| 5,762,143 | A | 6/1998 | Comeau et al. | |
| 5,857,522 | A | 1/1999 | Bradfield et al. | |
| 5,871,052 | A | 2/1999 | Benson et al. | |
| 5,900,137 | A | 5/1999 | Homan | |
| 5,901,064 | A | 5/1999 | Weber et al. | |
| 5,901,964 | A | 5/1999 | Williams et al. | |
| 5,971,072 | A | 10/1999 | Huber et al. | |
| 6,035,952 | A | 3/2000 | Bradfield et al. | |
| 6,138,774 | A | 10/2000 | Bourgoyne, Jr. et al. | |
| 6,234,258 | B1 | 5/2001 | Karigan | |
| 6,263,982 | B1 | 7/2001 | Hannegan et al. | |
| 6,328,118 | B1 | 12/2001 | Karigan et al. | |
| 6,343,649 | B1 | 2/2002 | Beck et al. | |
| 6,352,129 | B1 | 3/2002 | Best | |
| 6,374,925 | B1 | 4/2002 | Elkins et al. | |
| 6,386,288 | B1 | 5/2002 | Snider et al. | |
| 6,429,784 | B1 | 8/2002 | Beique et al. | |
| 6,457,540 | B2 | 10/2002 | Gardes | |
| 6,470,975 | B1 | 10/2002 | Bourgoyne et al. | |
| 6,484,816 | B1 | 11/2002 | Koederitz | |
| 6,571,869 | B1 | 6/2003 | Pluchek et al. | |
| 6,607,042 | B2 | 8/2003 | Hoyer et al. | |
| 6,653,460 | B1 | 11/2003 | Newcomb et al. | |
| 6,655,460 | B2 | 12/2003 | Bailey et al. | |
| 6,668,943 | B1 | 12/2003 | Maus et al. | |
| 6,719,071 | B1 | 4/2004 | Moyes | |
| 6,739,397 | B2 | 5/2004 | Ayling | |
| 6,755,261 | B2 | 6/2004 | Koederitz | |
| 6,805,199 | B2 | 10/2004 | Surjaatmadja | |
| 6,814,142 | B2 | 11/2004 | Paulk et al. | |
| 6,837,313 | B2 | 1/2005 | Hosie et al. | |
| 6,904,981 | B2 | 6/2005 | Van Riet | |
| 6,913,092 | B2 | 7/2005 | Bourgoyne et al. | |
| 6,920,942 | B2 | 7/2005 | Koederitz | |
| 7,004,448 | B2 | 2/2006 | Suter et al. | |
| 7,044,239 | B2 | 5/2006 | Pinckard et al. | |
| 7,158,886 | B2 | 1/2007 | Hou et al. | |
| 7,172,037 | B2 | 2/2007 | Dashevskiy et al. | |
| 7,350,597 | B2 | 4/2008 | Reitsma et al. | |
| 7,353,887 | B2 | 4/2008 | Krueger et al. | |
| 7,407,019 | B2 | 8/2008 | Kinder et al. | |
| 2003/0024737 | A1* | 2/2003 | Chang et al. | 175/25 |
| 2003/0079912 | A1 | 5/2003 | Leuchtenberg | |
| 2003/0098181 | A1 | 5/2003 | Aronstam et al. | |
| 2003/0106712 | A1 | 6/2003 | Bourgoyne | |
| 2003/0146001 | A1 | 8/2003 | Hosie et al. | |
| 2004/0007392 | A1 | 1/2004 | Judge et al. | |
| 2004/0069501 | A1 | 4/2004 | Haugen et al. | |
| 2004/0129424 | A1* | 7/2004 | Hosie et al. | 166/332.8 |
| 2004/0178001 | A1 | 9/2004 | Bourgoyne et al. | |
| 2004/0178003 | A1 | 9/2004 | Riet | |
| 2004/0206511 | A1 | 10/2004 | Tilton et al. | |
| 2004/0231889 | A1 | 11/2004 | Van Riet | |
| 2004/0238177 | A1 | 12/2004 | Fossli | |
| 2004/0262013 | A1 | 12/2004 | Tilton et al. | |
| 2005/0045382 | A1 | 3/2005 | Hosie et al. | |
| 2005/0061546 | A1 | 3/2005 | Hannegan | |
| 2005/0092523 | A1 | 5/2005 | McCaskill et al. | |
| 2006/0011236 | A1 | 1/2006 | Suter et al. | |
| 2006/0086538 | A1 | 4/2006 | Van Riet | |
| 2006/0124300 | A1 | 6/2006 | Steiner et al. | |
| 2006/0207795 | A1 | 9/2006 | Kinder et al. | |
| 2006/0254822 | A1 | 11/2006 | Ayling | |
| 2008/0035374 | A1 | 2/2008 | Reitsma | |

FOREIGN PATENT DOCUMENTS

| | | |
|---|---|---|
| EP | 1595057 | 7/2006 |
| GB | 2 430 951 | 4/2007 |
| GB | 2 440 452 | 1/2008 |
| WO | WO 02/50398 | 6/2002 |
| WO | WO 03/006778 | 1/2003 |
| WO | WO 03/071091 | 8/2003 |

OTHER PUBLICATIONS

Super Auto Choke, www.miswaco.com (2004).
SPE 5003, Formation Fracturing with Foam, Blauer, et al, (1974).
SPE 2544, The Rheology of Foam, David, et al (1969).
Petroleum Society of CIM, Fracturing with Foam, Bullen, et al, (1975).
Oil and Gas Journal, New Foams Introduce New Variables to Fracturing, Mack, et al, (1990).
The Design of Stable Foam Fracturing Treatments, Holditch, et al (date unknown).
World Oil, Aphron-based Drilling Fluid: Novel Technology for Drilling Depleted Formations, White, et al, (2003).
Foam Frac., B J—Hughes, Inc. (date unknown).
Combined Search Report and Examination Report, Application No. GB0603997.8, Aug. 2, 2006.
Canadian Office Action, Application No. 2,539,266, dated Oct. 25, 2007.
GB Search Report from Application No. GB0603997.8 dated Jan. 9 and Jan. 15, 2009.
Canadian Office Action for Application No. 2,539,266 dated Jan. 20, 2010.

* cited by examiner

MANAGED PRESSURE DRILLING

CROSS-REFERENCE TO RELATED APPLICATIONS

U.S. Pat. No. 6,837,313 and U.S. patent application Ser. No. 10/958,734 filed on Oct. 5, 2004 are incorporated by reference herein in their entireties.

BACKGROUND OF THE INVENTION

1. Field of the Invention

Embodiments of the present invention generally relate to managing pressure within a wellbore. More specifically, embodiments of the present invention relate to managing pressure within the wellbore relative to pressure within a surrounding earth formation.

2. Description of the Related Art

To obtain hydrocarbon fluid production within an earth formation, a drill string is typically used to drill a wellbore of a first depth into the formation. The drill string includes a tubular body having a drill bit attached to its lower end for drilling the hole into the formation to form the wellbore. Perforations are located through the drill bit to allow fluid flow therethrough.

While drilling with the drill string into the formation to form the wellbore, drilling fluid is circulated through the drill string, out through the perforations, and up through an annulus between the outer diameter of the drill string and a wall of the wellbore. Fluid is circulated within the wellbore to make a path within the formation for the drill string, to wash cuttings obtained from the earth due to drilling to the surface, and to cool the drill bit.

After the wellbore is drilled to the desired depth by the drill string, the drill string is removed from the wellbore. Sections or strings of casing are then inserted into the wellbore to line the wellbore. The casing is typically set within the wellbore by flowing cement into the annulus between the outer diameter of the casing and the wall of the wellbore. The drill string is then lowered through the casing and into the formation to drill the wellbore to a second depth, and an additional section or string of casing is lowered into the wellbore and set therein. The wellbore is drilled to increasing depths and additional casings set therein to the desired depth of the wellbore.

During the drilling and casing process, it is important to control the pressure within the wellbore ("Pw"). Pw is controlled with respect to the pressure within the formation ("$P_{pore}$"). The well is balanced when Pw is equal to $P_{pore}$.

When $P_{pore}$ greater than Pw, the well is underbalanced. Underbalanced is conditions within the wellbore facilitate production of fluid from the formation to the surface of the wellbore because the higher pressure fluid flows from the formation to the lower pressure area within the wellbore, but the underbalanced conditions may at the same time cause an undesirable blowout or "kick" of production fluid through the wellbore up to the surface of the wellbore. Additionally, if the well is drilled in the underbalanced conditions, production fluids may rise to the surface during drilling, causing loss of production fluid.

When the reverse pressure relationship occurs such that Pw is greater than $P_{pore}$, the well is overbalanced. Overbalanced conditions within the wellbore are advantageous to control the well and prevent blowouts from occurring, but disadvantages often ensue when Pw becomes substantially greater than $P_{pore}$. Specifically, the drilling fluid used when drilling the wellbore may flow into the formation, causing loss of expensive drilling fluid as well as decrease in productivity of the formation. Moreover, if Pw is substantially greater than $P_{pore}$, the drill string lowering into the wellbore may stick against the wellbore wall due to the drill string being pulled in the direction of fluid exiting into the formation, termed "differential sticking." Typically, differential sticking of the drill string has been addressed by physically jarring the drill string or by fishing the drill string from the wellbore.

The desirable pressure relationship between Pw and $P_{pore}$ varies in different situations. However, to avoid the disadvantageous results described above when drilling substantially overbalanced or substantially underbalanced, it is desirable to control Pw to be substantially equal to $P_{pore}$.

Generally, in a controlled wellbore, fluid pressure within the wellbore is maintained at a level above $P_{pore}$ of the formation and at the same time below the fracture pressure ("$P_{frac}$") of the formation. The $P_{pore}$ of the formation is the natural pressure of the formation. The $P_{frac}$ of the formation is the pressure at which the drilling fluid fractures and enters the formation. The controlled wellbore maintains a relationship between $P_w$ and $P_{pore}$ which prevents production fluid from entering the wellbore from the formation (by keeping $P_w$ above $P_{pore}$) and at the same time prevents drilling fluid from entering the formation (by keeping $P_w$ below $P_{frac}$).

Attempts to control $P_w$ take a variety of forms. Circulating drilling fluid within the wellbore while drilling with the drill string, along with its other advantages described above, affects the pressure within the wellbore. Flowing a sufficient volume of fluid into the wellbore at a sufficient flow rate and pressure may help prevent production fluid from flowing into the wellbore from the formation during drilling. Fluid properties of the drilling fluid such as density and viscosity also affect the pressure within the wellbore. Preferably, drilling fluid has a pressure at, but not above, $P_{pore}$.

Controlling $P_w$ when the variable of drilling fluid is involved is difficult because of the nature of fluid flow within the wellbore. With increasing depth of the wellbore within the formation, fluid pressure of drilling fluid within the wellbore correspondingly increases and develops a hydrostatic head which is affected by the weight of the fluid within the wellbore. The frictional forces caused by the circulation of the drilling fluid between the surface of the wellbore and the deepest portion of the wellbore create additional pressure within the wellbore termed "friction head." Friction head increases as drilling fluid viscosity increases. The total increase in pressure from the surface of the wellbore to the bottom of the wellbore is the equivalent circulation density ("ECD") of the drilling fluid. The pressure differential between ECD within the wellbore and $P_{pore}$ at increasing depths can cause the wellbore to become overbalanced, inviting the problems described above in relation to substantially overbalanced wells. The difference between ECD and $P_{pore}$ can be particularly problematic in extended reach wells, which are drilled to great lengths relative to their depths.

In addition to altering drilling fluid properties and/or flow rates in the attempt to control $P_w$ with respect to $P_{pore}$, sections or strings of casing are placed within the wellbore at intervals to help control $P_w$ with respect to $P_{pore}$. Conventionally, a section of wellbore is drilled to the depth at which the combination of hydrostatic and friction heads approach $P_{frac}$. A section or string of casing is then placed within the wellbore to isolate the formation from the increasing pressure within the wellbore before drilling the wellbore to a greater depth. When drilling extended reach wells, placing more casing strings or casing sections of decreasing inner diameters within the wellbore at increasing depths causes the path for conveyance hydrocarbons and/or running tools within the wellbore to become very restricted. Some deep wellbores are impossible to drill because of the number of casing sections or casing strings necessary to complete the well.

Along with setting casings into the wellbore and altering drilling fluid properties and flow rates from the surface of the wellbore to control $P_w$, other methods have been explored in attempts to control $P_w$ (including ECD). Specifically, a choke or other type of flow control device has been utilized at the surface of the wellbore to increase and decrease $P_w$. Attempts to choke flow at the surface are documented in U.S. Patent Application Publication No. 2003/0079912 and PCT Patent Application Publication Number WO 03/071091, which are both incorporated herein by reference in their entireties.

When using a valve to choke fluid flow at the surface during drilling, high wellhead pressure results. High wellhead pressure exerted on a blowout preventer ("BOP") increases strain on the equipment and could result in unsafe conditions due to lack of pressure barrier between the wellbore and the surface, possibly leading to shutdown of the operation at least for the time necessary to accomplish replacement of the BOP. There is a need to more effectively control $P_w$ without compromising the effectiveness of the BOP.

Many variables which affect the pressure of drilling fluid within the wellbore exist while drilling into the wellbore, including the motion and effect of the drill string while drilling into the formation, the nature of the formation being drilled, and the increasing ECD and hydrostatic pressures which accompany increasing depths. The largely unpredictable effects of these variables cause the wellbore pressure to constantly change, especially with increasing depth within the wellbore. The current efforts to control $P_w$ have largely depended upon manipulating $P_w$ from the surface of the wellbore, while the pressure of the drilling fluid within the wellbore constantly changes as the drilling fluid increases in depth. Because the drilling fluid downhole and its resulting pressure are difficult to predict, controlling the wellbore pressure downhole from the surface is not very exact.

An additional problem with controlling $P_w$ when drilling results because of the increasing pressure of fluid with increasing depth, or the sloped pressure gradient. Formation fluids within the interstitial spaces in the formation may not be adequately pressurized at one depth but too pressurized at another depth, so that the well is underbalanced at one depth and overbalanced at the other depth. Controlling $P_w$ with respect to $P_f$ at one depth may not control $P_w$ with respect to $P_f$ at another depth because of the increasing pressure of fluid with increasing depth. The attempts to control $P_w$ from the surface of the wellbore do not address the dynamic nature of the wellbore at different depths, as formation fluids are not consistently pressurized at different depths of the wellbore. Depending upon the depth of the wellbore, it can be impossible to maintain adequate wellbore pressure control throughout the wellbore without exceeding $P_{frac}$ under normal circumstances.

Foam is a type of drilling fluid which is used to transport cuttings, which are by-products of drilling into the formation, out of the wellbore to the surface of the wellbore. Foam is generally a gas in liquid dispersion stabilized by the inclusion of a foaming agent such as a surfactant. Ideally, gas is dispersed throughout the liquid to form a homogeneous gas-in-water emulsion. The gas is dispersed in the liquid as a discontinuous phase of microscopic bubbles, and the foaming agent holds together the gas and the liquid.

Because of its performance at high viscosity, favorable rheological behavior (flow behavior), and low fluid loss into the formation even without adding fluid-loss additives, foam is sometimes preferred for use as a drilling fluid. Additionally, foam advantageously possesses structural integrity in a given flow regime, is lightweight, has low hydrostatic head, and boasts excellent suspension of solids in a defined flow regime. The ability of foam to carry cuttings from bends in a wellbore or a washout within a wellbore where cuttings often rest and remain, typically causing the cuttings to exist beyond the reach of liquid drilling fluids, is another reason foam is sometimes preferred.

However, foam flow properties, including viscosity and shear strength of the foam, must be monitored and controlled while the foam is within the wellbore to maintain the cuttings-carrying capacity of the foam up to the surface of the wellbore. The cuttings-carrying capacity and flow properties of foam are dictated in one respect by the foam quality of the foam. In a typical wellbore, foam quality varies as the foam travels through the drill string, as well as when the foam travels up through the annulus between the drill string and the wellbore or the surrounding casing. Foam quality, which is defined as the ratio of gas volume to foam volume at a given pressure and temperature, is an important property of foam because the closeness of the gas bubbles to one another within the foam determines the ability of the foam to lift the cuttings to the surface of the wellbore without the cuttings falling through spaces in between the gas bubbles. The foam quality parameter dictates whether the foam has fallen outside of the range in which the mixture is a foam.

The use of foam is often problematic because the flow behavior of foam is almost impossible to accurately determine due to the expansion of foam as it travels up the annulus. It is desirable to maintain a substantially homogenous foam flow regime in the annulus. If the foam quality and other behavioral flow properties of the foam deviate outside of a given range, the cuttings-carrying ability of the foam is compromised and may result in insufficient removal of the cuttings from the wellbore. Currently, only an estimate of the pressure profile and resulting foam quality along the annulus of the wellbore is possible because pressure within the annulus is dependent upon the bottomhole pressure, hydrostatic head, friction pressure loss in the drill string and other tubulars, and expansion of the foam in the annulus, and only the bottomhole and surface pressures of the foam are known. Attempts to maintain foam quality in the annulus involve estimating foam quality by measuring pressure at the bottom of the wellbore, then estimating pressure in the annulus at depth intervals by calculations to obtain the desired wellhead pressure for maintaining cuttings-carrying capacity. Therefore, knowledge of the flow regime of the foam is effectively "lost" while the foam is traveling up through the annulus, in between the bottom of the wellbore and the surface of the wellbore, compromising effective cuttings removal. The publication "Formation Fracturing with Foam" by Blauer and Kohlhaas, SPE Paper No. 5003, copyright 1974, which describes the prior art method of estimating pressure and foam quality along the annulus with only a known bottomhole pressure, is herein incorporated by reference in its entirety.

There is therefore a need to more effectively and dynamically control pressure within the wellbore while drilling into the wellbore. More specifically, there is a need to control the pressure within the wellbore at various depths within the wellbore. There is a need to maintain well control at all depths of the wellbore by manipulating pressure within the wellbore. There is a further need to tailor a wellbore pressure profile for use during drilling. There is yet a further need to maintain a substantially homogenous foam flow regime in the annulus when foam is used as a drilling fluid to preserve cuttings-carrying capacity of the foam along the entire annulus.

SUMMARY OF THE INVENTION

In one embodiment, a method of drilling a wellbore in a formation comprises drilling the wellbore using a tubular body; circulating a foam through the tubular body and into an annulus between the outer diameter of the tubular body and the wellbore; and maintaining a substantially homogenous foam flow regime in the annulus using one or more pressure control mechanisms.

In another embodiment, a method of changing pressure within a wellbore comprises forming the wellbore using a drill string; circulating fluid into an annulus between an outer diameter of the drill string and a wall of the wellbore while forming the wellbore; and selectively choking the fluid in the annulus, thereby changing a pressure profile of the fluid flowing in the annulus.

A further aspect of embodiments of the present invention includes an apparatus for adjusting fluid pressure downhole within a wellbore, comprising a drill string; and a first pressure control mechanism located on the drill string and disposed within an annulus between the outer diameter of the drill string and a wall of the wellbore, the first pressure control mechanism providing an annular restriction and having a bore therethrough, wherein a dimension of the bore is adjustable when the first pressure control mechanism is downhole to alter fluid pressure within the wellbore.

In yet a further aspect, embodiments of the present invention provide a method of removing differential sticking within a wellbore in an earth formation, comprising forming the wellbore using a drill string; selectively connecting an energy transfer device to the drill string downhole upon differential sticking of the drill string within the wellbore; and operating the energy transfer device to transfer energy from drilling fluid pumped down the drill string to fluid circulating upwards in an annulus between an outer diameter of the drill string and a wellbore wall, thereby removing the differential sticking. In yet another aspect of embodiments of the present invention, a method is provided of transferring a portion of the load caused by the hydrostatic head of the fluid from sitting on the bottom of the wellbore to hanging from the drill string.

In a further aspect, embodiments of the present invention include a method of forming a wellbore, comprising inserting a tubular body into a wellbore formed in an earth formation; circulating a foamed cement through the tubular body and into an annulus between the outer diameter of the tubular body and the wellbore; and tailoring a density of the foamed cement along the annulus using one or more pressure control mechanisms.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention allow control of fluid pressure throughout the wellbore using various pressure control devices and various drilling fluids. Further, embodiments of the present invention provide sufficient pressure control within the wellbore to allow maintaining a given pressure profile throughout the wellbore. Additionally, embodiments of the present invention provide a closed-loop fluid circulating system for drilling wells in which fluid flow properties may be controlled, tailored as desired, and maintained for fluid flowing into the wellbore, return fluid flowing out of the wellbore, and fluid flowing throughout the entire wellbore.

Figure 1:
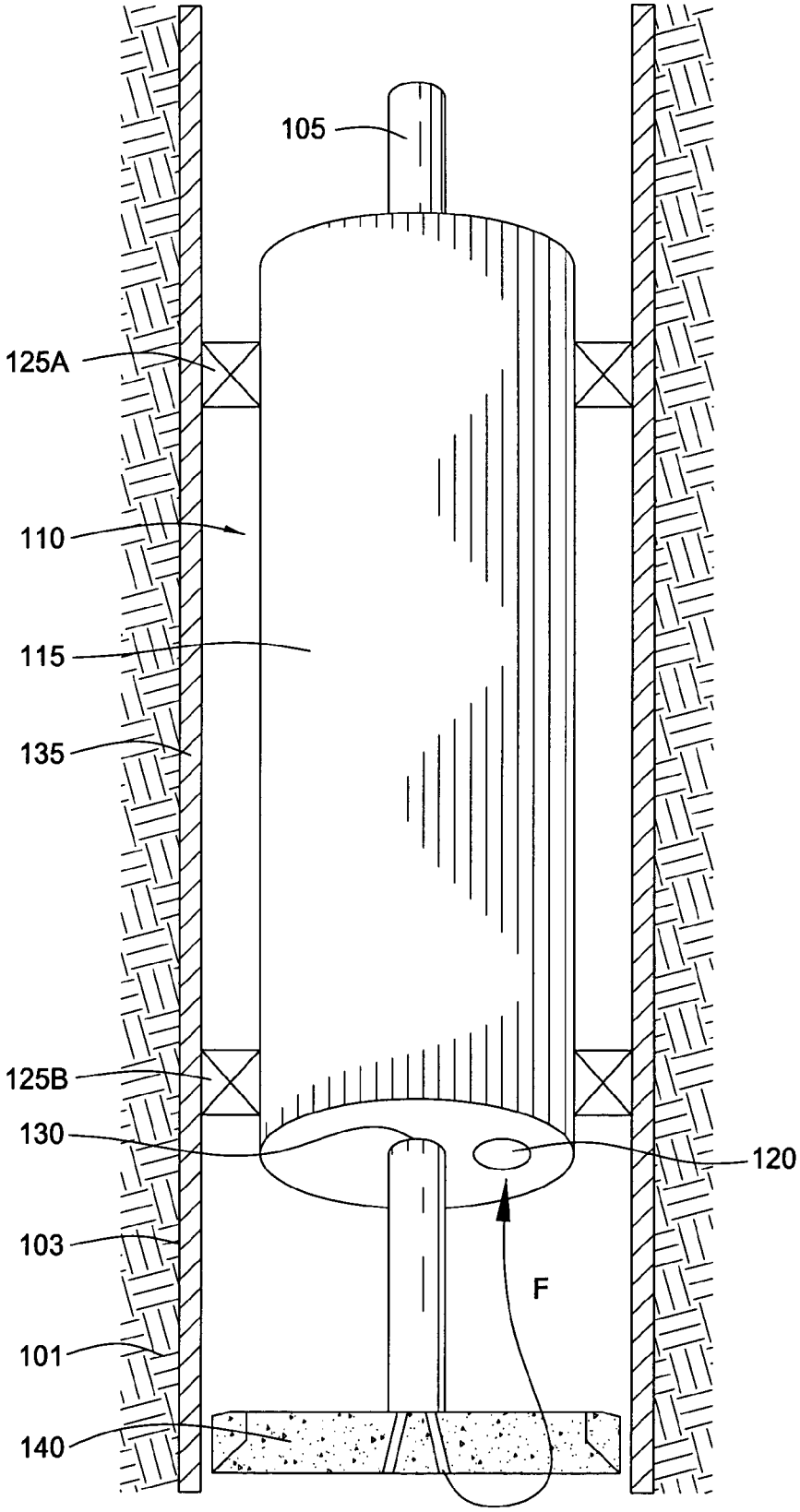
FIG. 1 is a sectional view of a first embodiment of a downhole choke disposed within a wellbore.
Figure 2:
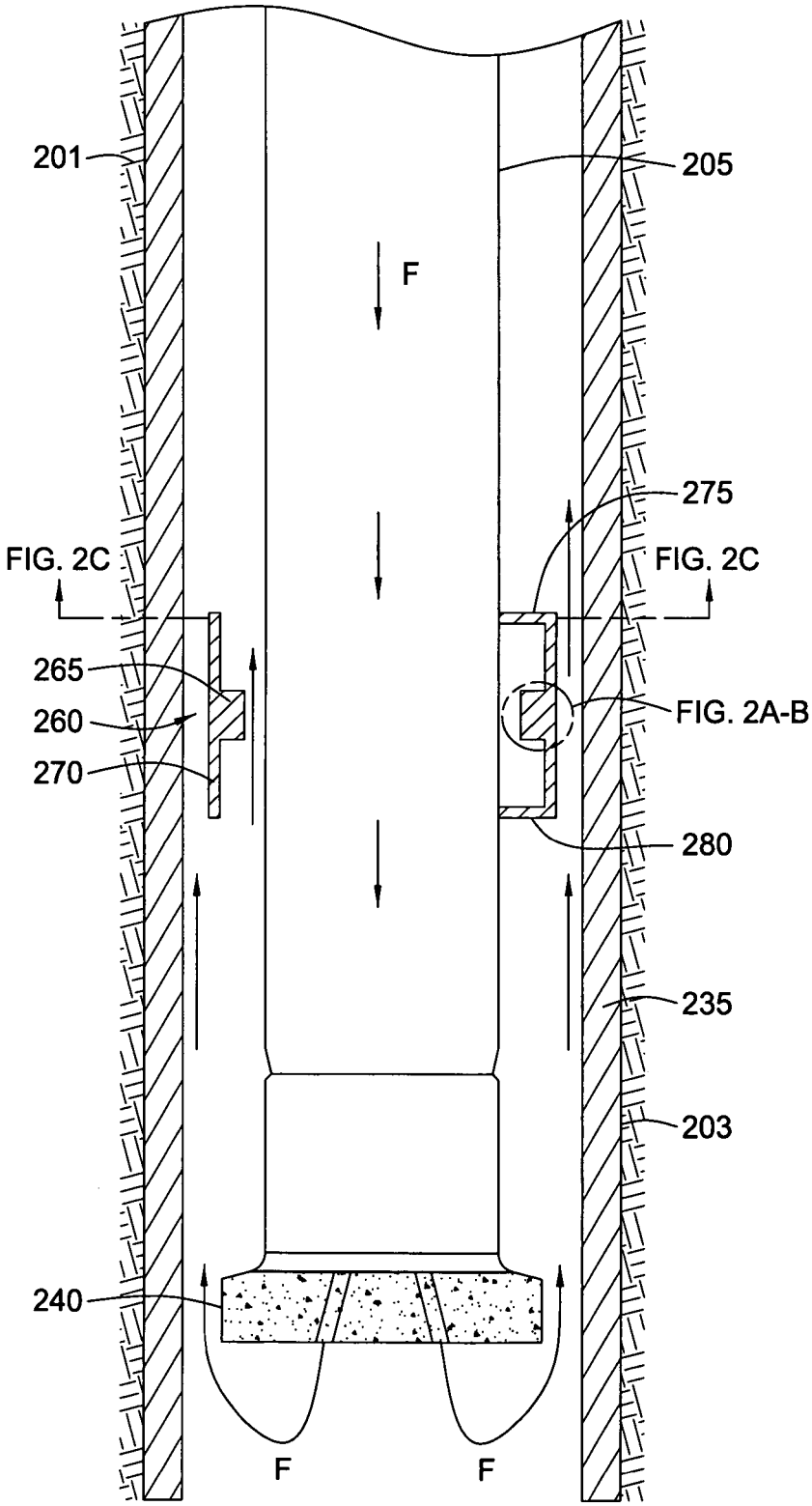
FIG. 2 is a cross-sectional view of a second embodiment of a downhole choke disposed within a wellbore.
Figure 3:
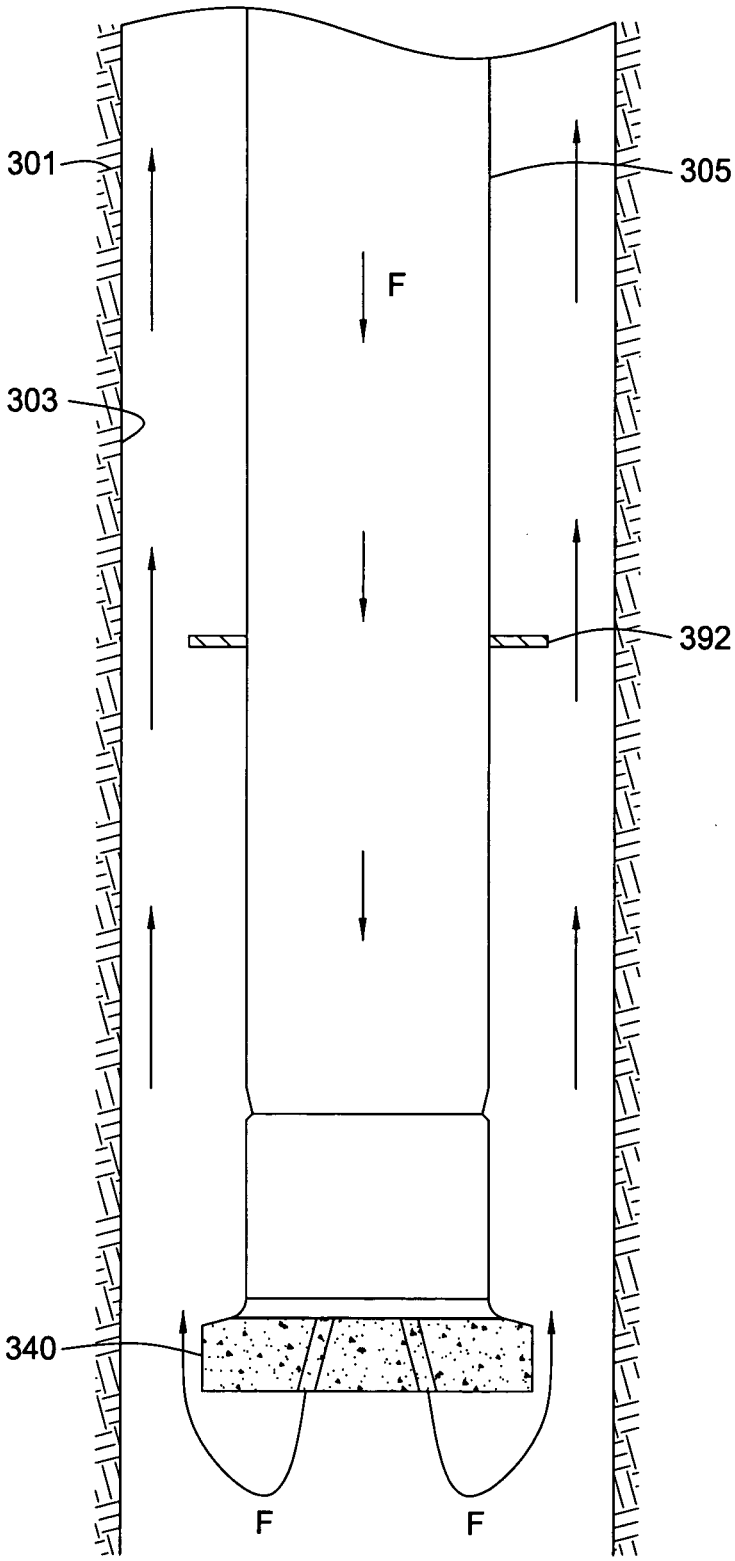
FIG. 3 is a cross-sectional view of a third embodiment of a downhole choke disposed within a wellbore.

In embodiments of the present invention, a downhole choke is utilized to affect fluid pressure within the wellbore. FIGS. 1-3 show embodiments of downhole chokes which reduce the pressure of drilling fluid circulating up through the annulus between the drill string and the wellbore above the downhole chokes, while increasing the pressure within the annulus below the downhole chokes by causing back-pressure within the annulus.

Referring first to FIG. 1, a drill string 105 having a downhole choke 110 on its outer diameter is disposed within a wellbore 103 within a formation 101. The wellbore 103 is shown partially cased with casing 135, although in other embodiments the drill string 105 is used to drill into the formation 101 to form a wellbore 103 prior to its casing. The drill string 105 includes a tubular body with a longitudinal bore therethrough, the tubular body having a drill bit 140 operatively connected to its lower end. The drill bit 140 may be any earth removal member capable of drilling a bore into the earth formation 101 when the drill string 105 is lowered into the formation 101. One or more perforations are included in the drill bit 140 to allow circulation of drilling fluid F therethrough.

The portion of the drill string 105 having the downhole choke 110 on its outer diameter may be separate from the remainder of the drill string 105 and connected to the drill string 105 when it is desired to employ the downhole choke 110 to reduce pressure within the annulus. In the alternative, the downhole choke 110 may be added to the outer diameter of a previously constructed drill string 105 and placed at the desired location on the drill string 105 to provide the appropriate pressure effects within the wellbore.

The downhole choke 110 has a choke body 115 which surrounds the drill string 105. Extending through the choke body 115 is a choke bore 120. The choke bore 120 may be of any shape and configuration for diverting annular fluid flow into the body 115 of the choke 110 to affect fluid pressures in the wellbore 103.

One or more sealing elements 125A, 125B extend from the outer diameter of the downhole choke 110 to the inner diameter of the casing 135 to substantially seal the annulus between the outer diameter of the drill string 105 proximate the downhole choke-encompassed portion and the casing 135. An upper sealing element 125A and a lower sealing element 125B are illustrated in FIG. 1 at each end of the downhole choke body 115, although it is contemplated that alternate embodiments of the present invention may include any number of sealing elements which may extend partially into the annulus or fully into the annulus to substantially or fully seal the annulus between the downhole choke 110 and the casing 135. Each sealing element 125A, 125B is preferably a static seal composed of rubber or another similar elastomeric element. In addition to the one or more sealing elements 125A, 125B, one or more mechanical seals 130 may be used to seal against fluid flow between the outer diameter of the drill string 105 and the inner diameter of the downhole choke body 115. In one embodiment, one or more of the sealing elements 125A, 125B are cup-type annular packing elements.

To seal the annulus between the drill string 105 and the casing 135, a type of rotating pressure control device may be utilized. Examples of rotating pressure control devices and methods of operation employable in embodiments include those disclosed in U.S. Pat. No. 6,263,982, U.S. Pat. No. 5,901,964, U.S. Pat. No. 6,470,975, U.S. Pat. No. 6,138,774, or U.S. Pat. No. 6,708,780, each of which patents is incorporated by reference herein in its entirety. Further examples of rotating pressure control devices and methods of operation employable in embodiments include those disclosed in U.S. patent application Ser. No. 10/995,980, U.S. patent application Ser. No. 10/281,534, U.S. patent application Ser. No. 10/666,088, or U.S. patent application Ser. No. 10/807,091, each of which applications is incorporated by reference herein in its entirety.

In operation, the drill string 105 with the downhole choke 110 thereon is lowered into the wellbore 103 while introducing drilling fluid F from the surface into the inner diameter of the drill string 105. Additionally, the drill string 105 (and downhole choke 110) may be rotated while lowering the drill string 105 into the wellbore 103. While the drill string 105 is lowered into the wellbore 103, the drilling fluid F flows through the inner diameter of the drill string 105 and out through the perforations in the drill bit 140, then up through the annulus between the outer diameter of the exposed drill string 105 and the inner diameter of the casing 135. If the drill string 105 is lowered into the formation 101 to drill a wellbore 103 of a further depth, the fluid F circulates up through the annulus between the outer diameter of the drill string 105 and the wall of the wellbore 103 formed in the formation 101, and the returning fluid flowing upward through the annulus includes cuttings from the drilled-out portion of the formation 101. As the fluid F continues to flow upward through the annulus, the bore 120 in the downhole choke 110 is the only unobstructed path for the fluid F to flow, as the choke body 115 acts as a solid obstruction between the drill string 105 and the casing 135 and as the portion of the annulus between the choke body 115 and the casing 135 which remains is sealed from fluid flow by the sealing elements 125B, 125A. Fluid F cannot flow back up through the drill string 105 bore because drilling fluid F is continuously introduced down through the drill string 105 to form an opposing force to any fluid attempting to re-enter the drill string 105 inner diameter. The drilling fluid F is thus forced by the downhole choke 110 to flow up through the choke bore 120, then out through the choke 110 and back into the annulus between the outer diameter of the drill string 105 and the inner diameter of the casing 135 located above the downhole choke 110.

The obstructed fluid path caused by the downhole choke 110, when used in cooperation with a pump, increases the pressure of the drilling fluid F flowing up through the portion of the annulus below the downhole choke 110 and also reduces the pressure of the drilling fluid F flowing into the portion of the annulus above the downhole choke 110. Therefore, the pressure of the drilling fluid F is less in the annulus above the downhole choke 110 than in the annulus below the downhole choke 110.

The pressure of the fluid F within the annulus may be manipulated in various ways using the downhole choke 110. The diameter of the choke bore 120 may be either adjustable or fixed. A hydraulic line or cable and a motor, or in the alternative an electric pipe (or both) may be utilized during drilling with the drill string 105 and operation of the downhole choke 110. When the diameter of the choke bore 120 is adjustable, the degree of restriction in fluid flow up through the choke bore 120 may be altered, thereby adjusting the fluid pressure below the choke 110 as well as the pressure at which the fluid flows out the upper end of the choke bore 120. The degree of restriction in fluid flow through the bore 120 may be changed by some communicating device, including but not limited to a pressure pulse device or a smart drill pipe (a pipe having communication means such as electrical cable or optical cable therethrough which communicates between surface equipment for controlling the restriction and sensing means for sensing downhole conditions so that the surface equipment may determine the amount of restriction needed to produce the desired pressure at the surface, then restrict the pipe diameter accordingly). As a general rule, increasing restriction in the diameter of the choke bore 120 decreases the pressure of the fluid F flowing out of the choke bore 120 into the annulus, and vice versa. At the same time, as a general rule, increasing the restriction in the diameter of the choke bore 120 in cooperation with pumping the fluid F increases the pressure of the fluid F within the portion of the annulus below the choke 110, and vice versa. In an alternate embodiment, an optional valve (open or closed) may be utilized to manipulate the fluid flowing through the choke bore 120.

Pressure of fluid F exiting from the choke 110 may also be adjusted by longitudinally altering the location of the choke 110 on the drill string 105. The choke 110 may be configured to slide along the drill string 105 by some downhole-communicating device, as described above in relation to adjusting the diameter of the bore 120 downhole. The sliding along of the choke 110 may be accomplished by using a rotating head-type choke, such as the choke incorporated by reference above. In the alternative, the position of the downhole choke 110 relative to the drill string 105 may be altered at the surface. Adjusting the position of the downhole choke 110 on the drill string 105 alters the pressure characteristics of the entering and exiting fluid F from the downhole choke 110, as pressure is controlled at the surface by controlling the volume of fluid F disposed within the wellbore 103 below the choke 110.

An advantageous feature of the downhole choke 110 of the present invention is its ability to readily act as a downhole blowout preventer ("BOP") if desired. To become a downhole BOP, the restriction to the inner diameter of the choke bore 120 fully obstructs the bore 120 to prevent any fluid F flow from escaping from the portion of the wellbore 103 below the downhole choke 110 to the annulus above the downhole choke 110 and thus close off a portion of the wellbore 103. The communication device (including one or more sensors) may be utilized to determine when the conditions of the wellbore 103 (e.g., pressure conditions) reach a state at which the fluid flow from the wellbore 103 should be closed off. The restriction in the bore 120 diameter may be capable of adjusting to variable diameters or may simply be a plug which completely obstructs flow through the bore 120 in blowout conditions.

An alternate embodiment of a downhole choke is shown in FIG. 2. Illustrated in FIG. 2 is a drill string 205 having a downhole choke assembly 260 on its outer diameter disposed in a wellbore 203 within a formation 201. A casing 235 may be set within the wellbore 203 by a physically alterable bonding material such as cement. The drill string 205 includes a tubular body having a longitudinal bore therethrough and a drill bit 240 operatively attached to a lower end of the tubular body. The drill bit 240, which has one or more perforations therethrough for flowing fluid through the drill bit 240, may be any earth removal member capable of drilling into an earth formation to form a wellbore 203.

The choke assembly 260 includes a generally cylindrical choke support 270 which is preferably (although not necessarily) substantially coaxial with the drill string 205. Extending from the choke support 270 is a choke 265. The choke 265 and the support 270 are both circumferential to obstruct a portion of the annulus between the wall of the wellbore 203 (and the inner diameter of the casing 235) and the outer diameter of the drill string 205.

Figure 2A:
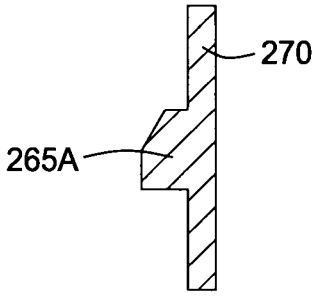
FIG. 2A is a sectional view of an alternate embodiment of a choke usable with the embodiment of FIG. 2.
Figure 2B:
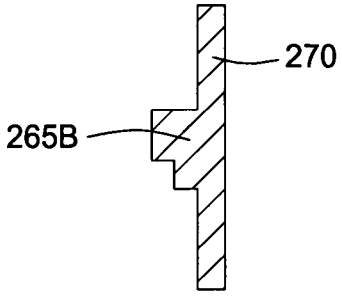
FIG. 2B is a sectional view of an alternate embodiment of a choke usable with the embodiment of FIG. 2.

The choke 265 may be of any size and shape, as the size and shape of the choke 265 represent variables affecting the pressure of the fluid F within the annulus above and below the choke 265. FIG. 2 shows one embodiment of a choke 265 wherein the shape is substantially rectangular in cross-section. FIGS. 2A and 2B show cross-sectional shapes of alternate embodiments of chokes 265A and 265B, respectively, which are within the scope of the present invention. The choke 265B of FIG. 2B is the choice which may be more efficient, produce less turbulence, and provide greater longevity compared to other choke shapes.

With respect to the size of the downhole choke 265, the longer the restriction to the annulus, the greater the choking effect (the greater the reduction in pressure from below the choke 265 to above the choke 265). Accordingly, and optionally, when it is desired to decrease the pressure above the choke 265 in the wellbore 203 relative to the wellbore 203 portion below the choke 265, the choke 265 length could be increased. The length may be adjustable by a communication device (as described above in relation to FIG. 1) acting on the choke 265 while the choke 265 is downhole to conform the length of the choke 265 to changing downhole conditions (e.g., pressure). Additionally, the position of the downhole choke 265 relative to the support 270 may affect the resulting pressure of the fluid F flowing into and out from the choke 265; therefore, the choke 265 location on the support may be adjustable manually or by a downhole communication device.

Connecting the support 270 (and therefore the downhole choke 265) to the drill string 205 is accomplished by another component of the choke assembly 260, namely two or more upper ribs 275 and/or two or more lower ribs 280. Although upper and lower ribs 275 and 280 are not both required, positioning the ribs 275, 280 near each end of the support 270 increases the sturdiness of the choke assembly 260 on the drill string 205.

Figure 2C:
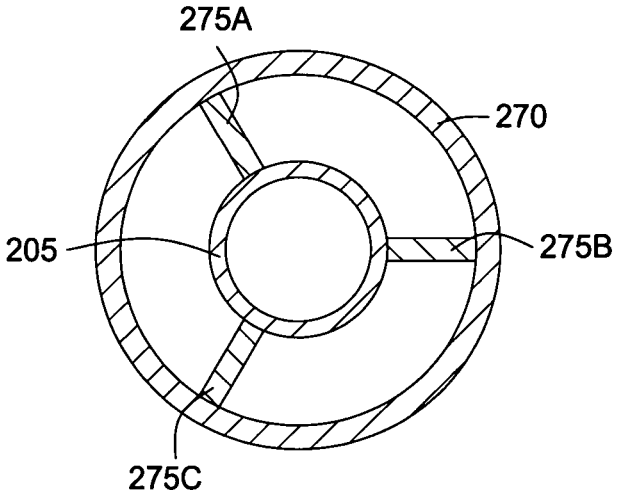
FIG. 2C is a cross-sectional view through line 2C-2C of FIG. 2.

FIG. 2C, which is a cross-section along line 2C-2C of FIG. 2, depicts one embodiment of the upper ribs 275 (and the embodiment may also be applied to the lower ribs 280). The upper ribs 275 (and the lower ribs 280) include three ribs 275A, 275B, and 275C spaced concentrically apart from one another. The ribs 275, 280 connect the choke assembly 260 to the outer diameter of the drill string 205, while still leaving annuluses between the ribs 275A, 275B, 275C (same for ribs 280) for fluid F flow therethrough (except at the choked portion).

The ribs 275, 280 may be rigidly fixed or may be adjustable radially inward and/or outward from the drill string 205 to change the choke 265 position within the annulus, thus affecting the pressure of the choked fluid above and below the choke 265. In the same vein, the choke 265 may be adjustable radially inward and/our outward from the support 270 to increase or decrease the restricted fluid F flow area within the annulus between the outer diameter of the drill string 205 and the wall of the wellbore 203 (or the inner diameter of the casing 235). Generally, increasing the restricted area (decreasing the inner diameter of the choke 265) causes a greater decrease in fluid pressure after the fluid passes through the choke 265, and vice versa. The radial extension and/or retraction of the ribs 275, 280 and/or the choke 265 may be accomplished by use of a communications device to alter the surface pressure of the fluid F as dictated by sensed downhole conditions (e.g., pressure), as described above. The location of the choke assembly 260 on the drill string 205 may also be adjustable by a downhole communications device to affect the decrease in pressure of the fluid F above the choke 265 and the increase in fluid pressure below the choke 265.

In operation, the downhole choke assembly 260 is placed on the outer diameter of the drill string 205 at a location. In the alternative, the downhole choke assembly 260 may be placed on a portion of the drill string 205 (a drill string section) and then the drill string section connected to the remainder of the drill string 205. The drill string 205 is then lowered into the wellbore 203 while drilling fluid F is flowed into the inner diameter of the drill string 205. The drilling fluid F then flows out through the perforation(s) in the drill bit 240, and the fluid F flows up into the annulus between the outer diameter of the drill string 205 and the wall of the wellbore 203. When the drill string 205 is lowered into the formation 201, cuttings from the earth formation 201 combine with the drilling fluid F when the fluid F exits from the drill bit 240 perforation(s). While the drill string 205 is lowered into the formation 201, the drill string 205 or a portion of the drill string 205 (e.g., the drill bit 240) may also be rotated to drill the wellbore 203 into the formation 201.

When the drilling fluid F reaches the downhole choke assembly 260, a portion of the fluid F flows between the outer diameter of the choke support 270 and the wall of the wellbore 203 (and the inner diameter of the casing 235), while the remaining portion of the fluid F flows through the annular spaces between the lower ribs 280. The area through which the fluid F may flow is then restricted by the downhole choke 265. A portion of the fluid F continues to flow around the outer diameter of the support 270, while the portion of the fluid F flowing within the choke assembly 260 is choked off by the downhole choke 265, so that the downhole choke 265 only permits a portion of the fluid flowing through the downhole choke assembly 260 to flow past the choke 265, creating a back-pressure on the fluid below the choke 265. Fluid F flow through the downhole choke assembly 260 continues within the annular spaces between the upper ribs 275, then the fluid stream flowing around the outer diameter of the choke assembly 260 and the fluid stream flowing through the choke assembly 260 merge as the fluid F flows further upward within the unobstructed annular space between the outer diameter of the drill string 205 and the wall of the wellbore 203 (and the inner diameter of the casing 235) above the choke assembly 260.

Before, after, and/or during the above-described operation of the embodiment shown in FIGS. 2-2C, the position, shape, size, and/or extension of the downhole choke assembly 260 and its components relative to the drill string 205 may be adjusted manually or automatically by determining the parameters of the fluid F above and/or below the choke assembly 260 and adjusting the position, shape, size, and/or extension to obtain the desired alterations of the fluid F parameters above and below the choke assembly 260. Regardless of whether the position, shape, size, and/or extension of the choke assembly 260 is altered before, during, or after the operation of the embodiments, the downhole choke inherently provides dynamic adjustment of the pressure of the fluid above and below the downhole choke because, in contrast to a surface choke, the downhole choke dynamically changes positions relative to the fluid F within the wellbore 203 because the drill string 205 constantly changes position within the wellbore 203 while drilling into the formation 201.

Yet a further embodiment of a downhole choke is shown in FIG. 3. FIG. 3 illustrates a drill string 305 having a downhole choke 392 around a portion of its outer diameter. The drill string 305 is disposed within a wellbore 303 formed within an earth formation 301. The drill string 305 includes a generally tubular body having a longitudinal bore therethrough and a drill bit 340 operatively connected to the lower end of the tubular body. One or more perforations for allowing fluid flow therethrough are formed through the drill bit 340.

The downhole choke 392 may be formed of a size (length and width) calculated to reduce pressure thereabove and increase pressure therebelow to extent desired. Additionally, the downhole choke 392 may be located at a longitudinal portion of the drill string 305 to reduce and increase pressure the desired amount. The shape of the downhole choke 392 may be substantially rectangular in cross-section, as shown in FIG. 3, or may be formed in the shape of the choke 265A of FIG. 2A, the choke 265B of FIG. 2B, or any other shape capable of producing the desired pressure reduction or increase at the desired amount of flow turbulence in fluid F flowing above or below the downhole choke 392.

The downhole choke 392 may be adjustable in a variety of ways. Specifically, the downhole choke 392 may be extendable radially from the drill string 305, extendable longitudinally along the drill string 305, and/or moveable in position on the drill string 305. The downhole choke 392 may be adjustable using a communication device, as described above in relation to FIGS. 1 and 2.

In operation, the downhole choke 392 is placed on the drill string 305 at the desired location. The drill string 305 is lowered into the formation 301 to drill out the wellbore 303 while simultaneously circulating drilling fluid F through the drill string 305. The drill string 305 (or a portion thereof) may optionally be rotated while it is lowered into the formation 301.

Drilling fluid F introduced into the drill string 305 flows down through the drill string 305, out through the perforation (s), and up through the annulus between the wall of the wellbore and the outer diameter of the drill string 305 portion below the downhole choke 392. A portion of the fluid F then flows around the outer diameter of the choke 392, the point at which the fluid F path is choked, and then up above the choke 392 in the annulus between the outer diameter of the drill string 305 and the wall of the wellbore 303. The downhole choke 392 causes the pressure of the fluid F flowing above the choke 392 to be less to a degree than the pressure of the fluid F below the choke 392. At any point during this process, the downhole choke 392 position and/or size may be manually and/or automatically adjusted to obtain the pressure desired of the fluid F above or below the downhole choke 392, because the desired wellbore conditions change or the downhole characteristics change or for any other reason. The communication device may measure parameters and adjust the characteristics of the downhole choke 392 accordingly to obtain the desired pressure of fluid F at portions of the wellbore 303.

Figure 4:
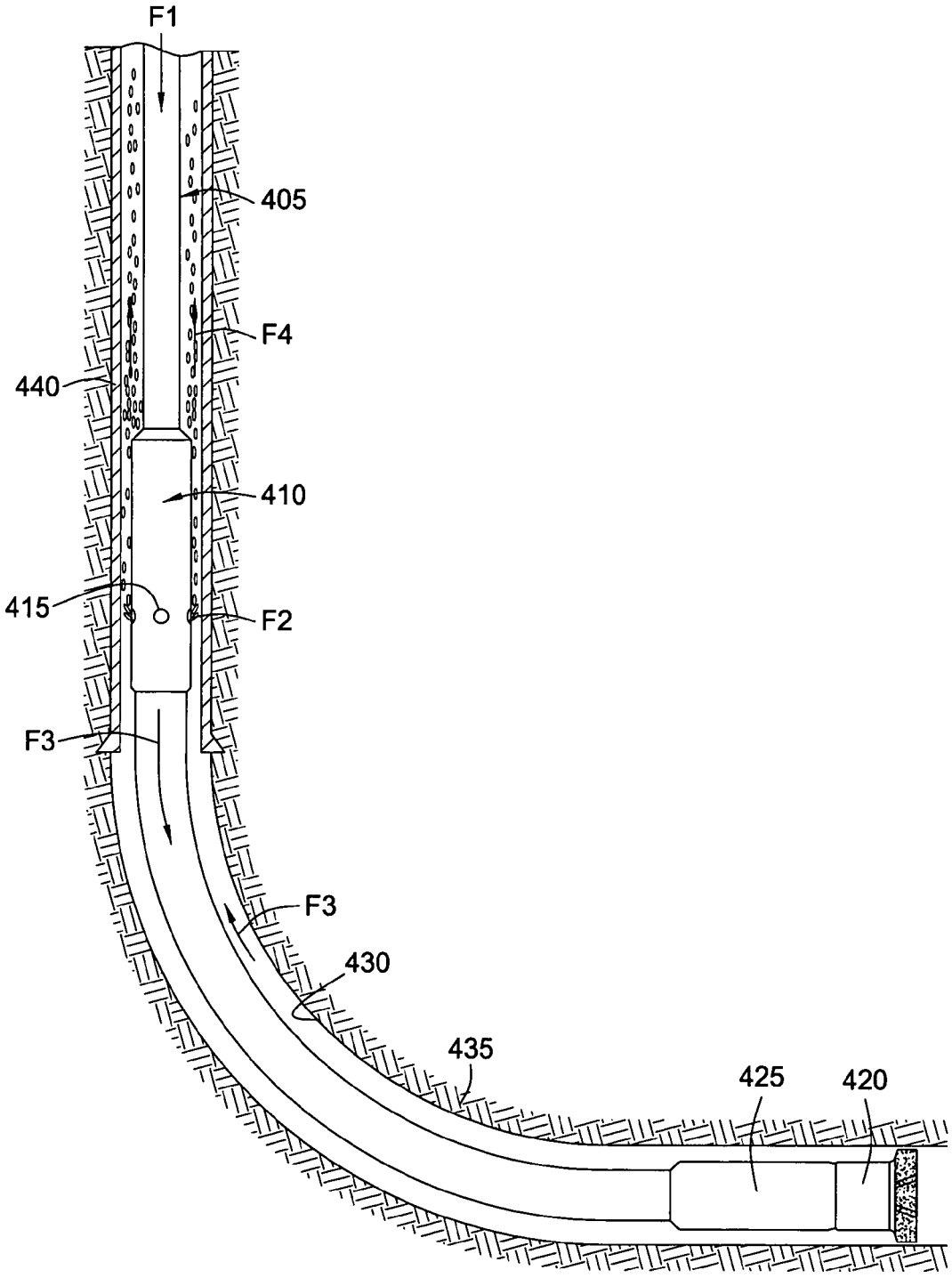
FIG. 4 is a sectional view of downhole separator within a tubular string.
Figure 5:
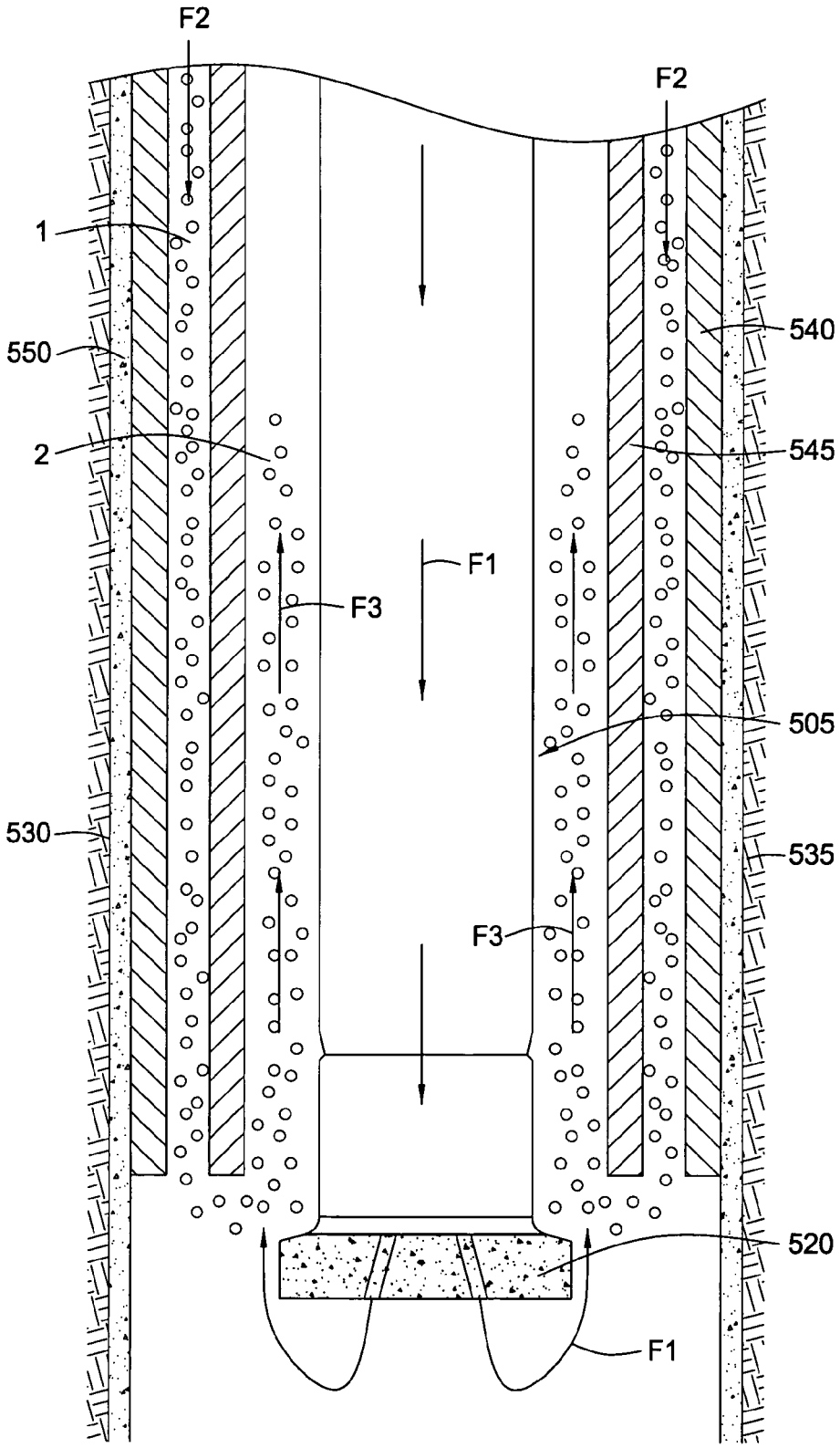
FIG. 5 is a sectional view of a fluid flowing from the surface of a wellbore into an annulus between concentric tubular bodies within the wellbore.
Figure 6:
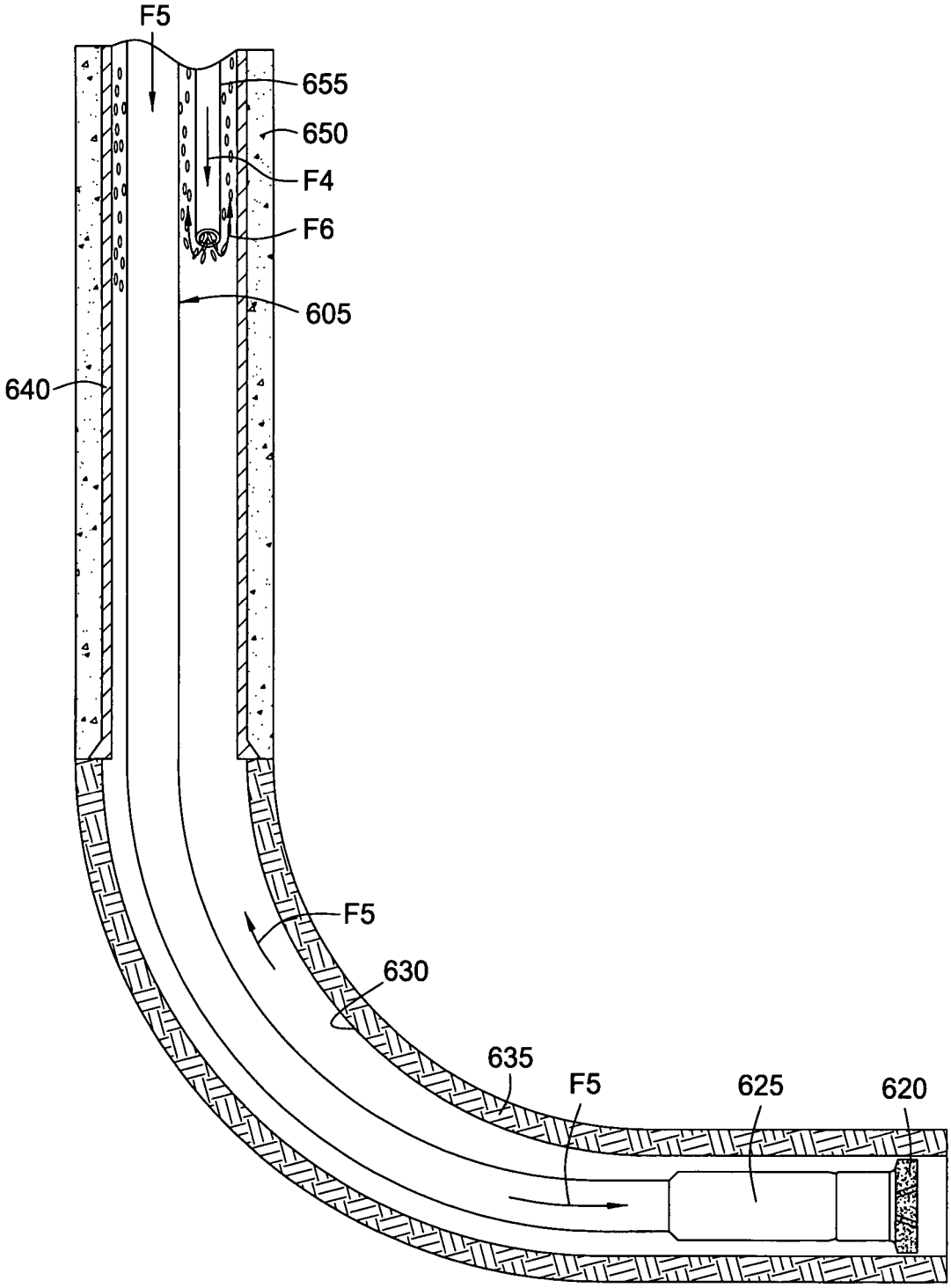
FIG. 6 is a sectional view of a downhole injecting device for introducing fluid into an annulus between a drill string and a wellbore.

FIGS. 4-6 show various embodiments of apparatus and methods for reducing equivalent circulating density ("ECD") within the wellbore while drilling into the earth formation to form the wellbore. The embodiments shown in FIGS. 4-6 lighten drilling fluid introduced into a drill string to reduce pressure downhole by decreasing hydrostatic head exerted on the surrounding formation. The drilling fluid is lightened as it flows up the annulus between the wellbore wall and the outer diameter of the drill string in each embodiment.

FIG. 4 depicts a drill string 405 drilling into an earth formation 435 to form a wellbore 430. A section or string of casing 440 is located within the wellbore 430 and preferably set within the wellbore 430 by a physically alterable bonding material, which is most preferably cement, disposed within the annulus between the outer diameter of the casing 440 and the wall of the wellbore 430. The drill string 405 is located within the casing 440.

The drill string 405 includes a generally tubular body having a longitudinal bore therethrough. Within the drill string 405, a downhole separating device 410 is located for separating a fluid stream F1 into a fluid stream F2 and a fluid stream F3, wherein the fluid stream F2 is lighter in weight than the fluid stream F3. Most preferably, the fluid stream F2 is at least substantially in the gas phase, and the fluid stream F3 is at least substantially in the liquid phase. The separating device 410 includes any known separating device for separating a fluid stream into separate liquid-phase and gas-phase streams (or at least any known device for separating a fluid stream into at least two separate fluid streams, each fluid stream having a different density or weight from the other fluid stream), such as a separator, but preferably includes a hydrocyclone. The separator possesses a longitudinal bore therethrough in fluid communication with the bores of the tubular body portions of the drill string 405 so that fluid stream F3 exiting the separating device 410 may flow through the lower portion of the drill string 405 to power the drill bit 420 and/or to remove cuttings obtained from drilling into the formation 435 below and around the drill string 405. One or more apertures 415 are disposed in a wall of the separating device 410 to provide an exit point for the fluid stream F2 flowing into the annulus after its separation from the fluid stream F1.

Operatively connected to a lower end of the drill string 405 is a drill bit 420 or some other form of an earth removal member for forming the wellbore 430 in the formation 435. The drill string 405 may further include a drill motor 425 for rotating the drill bit 420 when desired or a bottomhole assembly ("BHA") which may include the drill motor 425 along with one or more stabilizers and/or directional drilling features.

In operation, the casing 440 is set within a previously drilled-out portion of the wellbore 430. To drill a further portion of the wellbore 430, the drill string 405 is lowered first through the casing 440 and then drilled into the formation 435 to form the wellbore 430. The separating device 410 and other components of the drill string 405 may either be assembled prior to insertion of the drill string 405 into the casing 440, or each component may be connected to the drill string 405 as it is lowered into the casing 440 and formation 435. Along with the drill string 405 being lowered into the formation 435 to form the wellbore 430, the entire drill string 405 or a portion of the drill string 405 may be rotated while the drill string 405 is lowered into the formation 435 (e.g., the drill bit 420 may be rotated by the drill motor 425).

As the drill string 405 is lowered into the formation 435 to form the wellbore 430, a fluid stream F1, which preferably includes a mixture of liquid and gas, most preferably a foam, is introduced into the drill string 405 from the surface of the wellbore 430. The fluid stream F1 flows through the drill string 405 into the separating device 410, which separates the lighter fluid stream F2 from the fluid stream F3. The fluid stream F3 continues to flow downward through the drill string 405 and out through one or more perforations through the drill bit 420, where the fluid stream F3 combines with cuttings from the formation 435 obtained when forming the wellbore 430 to flow up through the annulus between the wellbore 430 wall and the outer diameter of the portion of the drill string 405 below the separating device 410.

After separation, the lighter fluid stream F2 exits through the aperture(s) 415 of the separating device 410, then combines with the fluid stream F3 (and the cuttings) to form liquid/gas mixture stream F4 which flows upward through the annulus between the wall of the wellbore 430 and the outer diameter of the separating device 410 as well as the outer diameter of the portion of the drill string 405 above the separating device 410. The fluid stream F2 exiting the separating device 410 combines with the fluid stream F3 to form the fluid stream F4 which is lighter in weight than the fluid stream F3, thereby reducing hydrostatic head exerted on the formation 435 below the separating device 410 to aid in lifting the fluid stream F3 and the cuttings upward through the annulus.

In one embodiment, the wellbore 430 is drilled in an underbalanced state, where the pressure of the formation 435 is higher than the pressure in the wellbore 430, or in a near balanced state, where the pressure in the formation 435 is substantially equal to the pressure in the wellbore 430. Although the above description involves separating the fluid stream F1 into a liquid stream F3 and a fluid stream F2, it is also within the scope of embodiments of the present invention that the fluid stream F2 may merely include a lower density liquid than the density of the liquid stream F3 or a lower density liquid/gas mixture than the liquid stream F3 density, as the goal is simply to lighten the liquid stream F3 using the fluid stream F2. Because the separating device 410 is downhole during the drilling operation and continues further downhole to various locations during the operation, hydrostatic head is continuously reduced by the fluid stream F2 flowing from the separating device 410 at an effective location within the wellbore 430 for lightening fluid dynamically. The liquid and gas phases are separated downhole to lighten the fluid flowing to the surface of the wellbore 430 and lift fluid F3 and cuttings below the separator 410.

An additional embodiment for lightening the drilling fluid as it circulates up through the annulus between the drill string and the wellbore is shown in FIG. 5. Specifically, FIG. 5 illustrates concentric casings 540 and 545, including inner casing 545 and outer casing 540, disposed within a wellbore 530 formed in a formation 535. The concentric tubulars such as concentric casings 540 and 545 may be lowered into the wellbore 530 together, or in the alternative, the outer casing 540 may be lowered into the wellbore 530 prior to lowering the inner casing 545 into the outer casing 540. The inner casing 545 may be hung just below the BOP (not shown). The outer casing 540 is set within the wellbore 530, preferably by a physically alterable bonding material such as cement 550 within the annulus between the outer diameter of the outer casing 540 and the wall of the wellbore 530. The inner casing 545 may be hung within the wellbore 530 by a casing hanger (not shown) or any other means of hanging casing within the wellbore 530 while leaving at least a portion of the annulus between the outer diameter of the inner casing 545 and the inner diameter of the outer casing 540 unobstructed (to allow fluid flow therethrough, as described more fully below).

A drill string 505 is located within the inner diameter of the inner casing 545. The drill string 505 is a generally tubular body having a drill bit 520 or some other earth removal member operatively connected to the lower end of the tubular body. The drill bit 520 preferably includes one or more perforations which allow fluid flow through the drill bit 520.

In operation, the inner and outer casings 545 and 540 are located within a drilled-out portion of the wellbore 530, either together or separately. The outer casing 540 is set within the wellbore 530 after running the outer casing 540 into the wellbore 530, while the inner casing 545 may be hung off the outer casing 540 before or after its insertion into the wellbore 530.

The drill string 505 is then lowered into the inner casing 545. While the drill string 505 is lowered into the inner casing 545, the entire drill string 505 or a portion thereof, such as the drill bit 520, may be rotated. Additionally, drilling fluid F1 is introduced into the inner diameter of the drill string 505 from the surface of the wellbore 530 while a fluid F2 having a lower density than the fluid F1 is introduced (preferably pumped) from the surface of the wellbore 530 into the annulus between the inner diameter of the outer casing 540 and the outer diameter of the inner casing 545. The lower density fluid F2 may include a fluid in the gas phase, a fluid in the liquid phase, or a liquid/gas mixture, the fluid F2 regardless of form having a lesser density than the fluid F1. If the lower density fluid F2 is a gas-phase stream, the gas may include a nitrogen gas.

The drilling fluid F1 flows through the length of the drill string 505 and out through the perforation(s) in the drill bit 520. Once the fluid stream F1 exits the drill bit 520, it gathers cuttings produced from the drilled-out formation 535. The fluid stream F2 flows down through the annulus between the outer casing 540 and inner casing 545, then around the inner casing 545 to merge with the fluid stream F1 when the fluid stream F1 traveling up the annulus between the outer diameter of the drill string 505 and the wall of the wellbore 530 reaches the lower end of the inner casing 545. The fluid streams F1 and F2 merge into one another to form fluid stream F3, which ultimately continues up through the annulus between the outer diameter of the drill string 505 and the inner diameter of the inner casing 545 to the surface of the wellbore 530.

Similar to the embodiment of FIG. 4, the lighter fluid F2 introduced into the annulus between concentric casings 540 and 545 lightens the fluid F1 flowing up through the annulus between the drill string 505 and the inner casing 545 to the surface of the wellbore 530, thereby reducing the ECD and hydrostatic head exerted on the formation 535 and lifting fluid F1 below the inner casing 545 through the annulus. The lighter fluid F2 also helps lift the cuttings produced from drilling into the formation 535. The embodiment shown and described in relation to FIG. 5 introduces a lightening fluid downhole into the upward-flowing drilling fluid circulation stream.

FIG. 6 shows an alternate embodiment for lightening fluid flowing to the surface after the fluid circulates through a drill string. Illustrated in FIG. 6 is a casing 640 located within a wellbore 630 drilled into a formation 635. The casing 640 is preferably set within the wellbore 630 by a physically alterable bonding material such as cement 650 disposed in the annulus between the outer diameter of the casing 640 and the wall of the wellbore 630.

A drill string 605 is located within the inner diameter of the casing 640. The drill string 605 includes a generally tubular body having a longitudinal bore therethrough and a drill bit 620 operatively connected to its lower end. The drill bit 620, which may be any form of earth removal member, has one or more perforations therethrough for fluid flow. The drill string 605 may further include a drill motor 625 or BHA for rotating the drill bit 620.

Also included in the embodiment of FIG. 6 is an injecting device 655 disposed within the annulus between the inner diameter of the casing 640 and the outer diameter of the drill string 605. The injecting device is used for injecting a lightening fluid F4 (e.g., a gas) into the annulus between the inner diameter of the casing 640 and the outer diameter of the drill string 605. The injecting device 655 is shown as a tubular string, but may be of any configuration capable of injecting a fluid into the annulus.

In operation, the casing 640 is initially set within a portion of the wellbore 630. The drill string 605 is lowered into the inner diameter of the casing 640 and eventually reaches an un-drilled portion of the formation 635 below the casing 640. The drill string 605 then drills a further portion of the wellbore 630 into the formation 635. While lowering the drill string 605, the entire drill string 605 or a portion thereof may optionally be rotated (e.g., the drill bit 620 may be rotated by the drill motor 625).

While the drill string 605 is lowered into the wellbore 630, drilling fluid F5 is introduced into the inner diameter of the drill string 605 from the surface of the wellbore 630. The drilling fluid F5 is introduced to remove cuttings from the wellbore 630 as well as to clean, cool, and power the drill bit 620, if desired. The drilling fluid F5 flows down through the drill string 605, out through the perforation(s) in the drill bit 620, and up through the annulus between the outer diameter of the drill string 605 and the wall of the wellbore 630. When the fluid F5 reaches the casing 640, the fluid F5 flows up in the annulus between the inner diameter of the casing 640 and the outer diameter of the drill string 605.

As the drill string 605 is lowered into the wellbore 630 and fluid F5 is flowed into the drill string 605, a fluid F4 having a lower density than the fluid F5 is injected into the annulus using the injecting device 655. The fluid F4 is preferably a gas, which may be nitrogen gas, but may include any vapor, liquid, or liquid/vapor mixture which is lighter (less dense) than the drilling fluid F5. When the fluid F5 reaches the portion of the injecting device 655 which injects the fluid F4 into the wellbore 630, the fluid F5 merges with the fluid F4 being injected to form a fluid stream F6 which flows up through the annulus between the outer diameter of the injection device 655 and the inner diameter of the casing 640, as well as up through the annulus between the outer diameter of the injection device 655 and the outer diameter of the drill string 605, then ultimately up to the surface of the wellbore 630.

The lightening fluid F4, as stated above in relation to the embodiments of FIGS. 4 and 5, reduces the equivalent circulation density of the drilling fluid F5 and reduces the hydrostatic head exerted on the formation 635. Additionally, the lighter fluid F4 provides lifting force to the drilling fluid stream F5 and cuttings therein being circulated to the surface of the wellbore 630.

Regardless of the method or apparatus utilized to lighten the drilling fluid flowing up through the annulus between the drill string and the wellbore, a separating device may be used at the surface of the wellbore after the fluid flows up to the surface through the annulus to separate the fluid exiting the annulus into two or more fluid streams having varying densities. One of the separated fluid streams may then be recycled through the inner diameter of the drill string while drilling or when drilling in an additional drill string.

The above embodiments shown and described in relation to FIGS. 4-6 are especially advantageous in extended reach wells, where the fluid friction significantly increase the pressure of the drilling fluid circulated with increasing depth. The composition, flow rate, and/or other properties of the lighter fluid in the annulus may be utilized to tailor the fluid weight, pressure, and equivalent circulation density within the wellbore relative to the pressure of the surrounding formation.

When the embodiments of FIGS. 4-6 are utilized to reduce pressure within the wellbore 430, 530, 630, the drilling fluid circulation eventually is halted, either when the drill string 405, 505, 605 reaches its desired drilling depth within the formation 435, 535, 635 or at some other point during drilling. When the flow of drilling fluid is stopped, the pressure within the wellbore 430, 530, 630 will increase from the ECD pressure to the hydrostatic pressure of the drilling fluid remaining within the wellbore 430, 530, 630 so that at least a small amount of drilling fluid will sometimes be forced into the formation 435, 535, 635. To prevent drilling fluid from entering the formation 435, 535, 635 or at least reduce the amount of drilling fluid flowing into the formation 435, 535, 635 upon completion of the circulation of drilling fluid, possible solutions exist.

A first solution involves pumping a specific amount of lighter liquid or gas down the drill string 405, 505, 605 prior to stopping the flow of drilling fluid into the drill string 405, 505, 605. Pumping the lighter fluid down the drill string 405, 505, 605 reduces the hydrostatic head at the bottom of the wellbore 430, 530, 630 to eventually match the pressure of the formation 435, 535, 635. The lighter fluid is introduced into the drill string 405, 505, 605 while slowing and eventually stopping the pumping of the drilling fluid into the wellbore 430, 530, 630.

In a second solution, a valve or regulator (not shown) may be disposed in the drill string 405, 505, 605 which opens only when a differential pressure or differential flow rate exists across the valve or regulator. The valve or regulator is configured so that opening the valve or regulator produces a resulting pressure drop within the bottom of the wellbore 430, 530, 630 to reduce hydrostatic pressure of the fluid. Upon stopping the pumping of drilling fluid into the drill string 405, 505, 605, the valve or regulator will close, leaving a reduced pressure below the valve or regulator.

When using the embodiment shown and described above in relation to FIG. 4, the drilling fluid is often already lightened sufficiently because the separating device 410 reaches the fluid prior to its falling downhole, even when introduction of fluid from the surface is stopped. Because the hydrostatic head is already reduced so that downhole pressure within the wellbore 430 is similar to pressure within the formation 435, the above-suggested solutions of pumping lighter fluid into the drill string 405 or including a valve or regulator in the drill string 405 may not be necessary.

When the flowing pressure and hydrostatic pressure are significantly different, the above solutions may not be drastic enough to closely equate the wellbore and formation pressures. In this situation, a shutdown plan may be employed when drilling fluid flow is halted to introduce a defined amount of lighter fluid or gas into the drill string 405, 505, 605 as well as into the annulus between the drill string 405, 505, 605 and the wellbore 430, 530, 630 wall to maintain the desired pressure within wellbore 430, 530, 630.

Especially in extended-reach wells or small wellbore wells, halting flow of drilling fluid can cause a blowout or premature hydrocarbon production. In these wells, the flowing pressure is usually greater than the pressure of the formation and the hydrostatic head is less than the formation pressure. To regulate the pressure within the wellbore relative to the pressure of the formation and reduce the chances of a blowout or premature hydrocarbon production, additional pressure control devices may be utilized at the surfaces and/or within the wellbores of the embodiments shown and described in relation to FIGS. 4-6. Specifically, a downhole choke and/or BOP (such as the rotating head with the choke valve incorporated by reference above) may be utilized in the embodiments of FIGS. 4-6, such as the downhole chokes shown and described in relation to FIGS. 1-3 above. As mentioned above, the downhole choke 110 of FIG. 1 may be utilized as a downhole choke as well as a BOP. In the alternative, a separate BOP from the downhole choke may be utilized with any of the embodiments shown in FIGS. 1-3 in the embodiments shown and described in relation to FIGS. 4-6. The downhole choke and/or BOP may be utilized at the exit of the annulus between the drill string 405, 505, 605 and the wellbore 430, 530, 630 to maintain pressure at the surface of the wellbore 430, 530, 630 and/or increase pressure on the formation 435, 535, 635 from the wellbore 430, 530, 630.

An alternate solution to the problem of regulating pressure encountered in extended reach and small wellbore wells involves injecting heavier drilling fluid into the drill string 405, 505, 605 and/or into the annulus between the drill string 405, 505, 605 and the wellbore 430, 530, 630 than the drilling fluid previously introduced into the annulus before flow stoppage, as opposed to injecting the lighter fluid as described as a previous solution. Static equilibrium may thus be achieved when flow of drilling fluid is stopped.

FIGS. 7-11 show embodiments of pressure control devices including ECD reduction tools. FIGS. 7-11 illustrate various combinations of selective annular return choking and backpressure pumping of drilling fluid with downhole fluid lifting. Combining the annular return choking and backpressure pumping with downhole fluid lifting allows the slope of the line and the scalar value of the wellbore pressure profile to be changed as desired. In one embodiment, a virtually constant pressure may be maintained within the wellbore over a depth interval using embodiments as shown and described below in relation to FIGS. 7-11. The wellbore fluid system could be tailored more closely than currently possible to a static well control system without formation damage potential.

Figure 7:
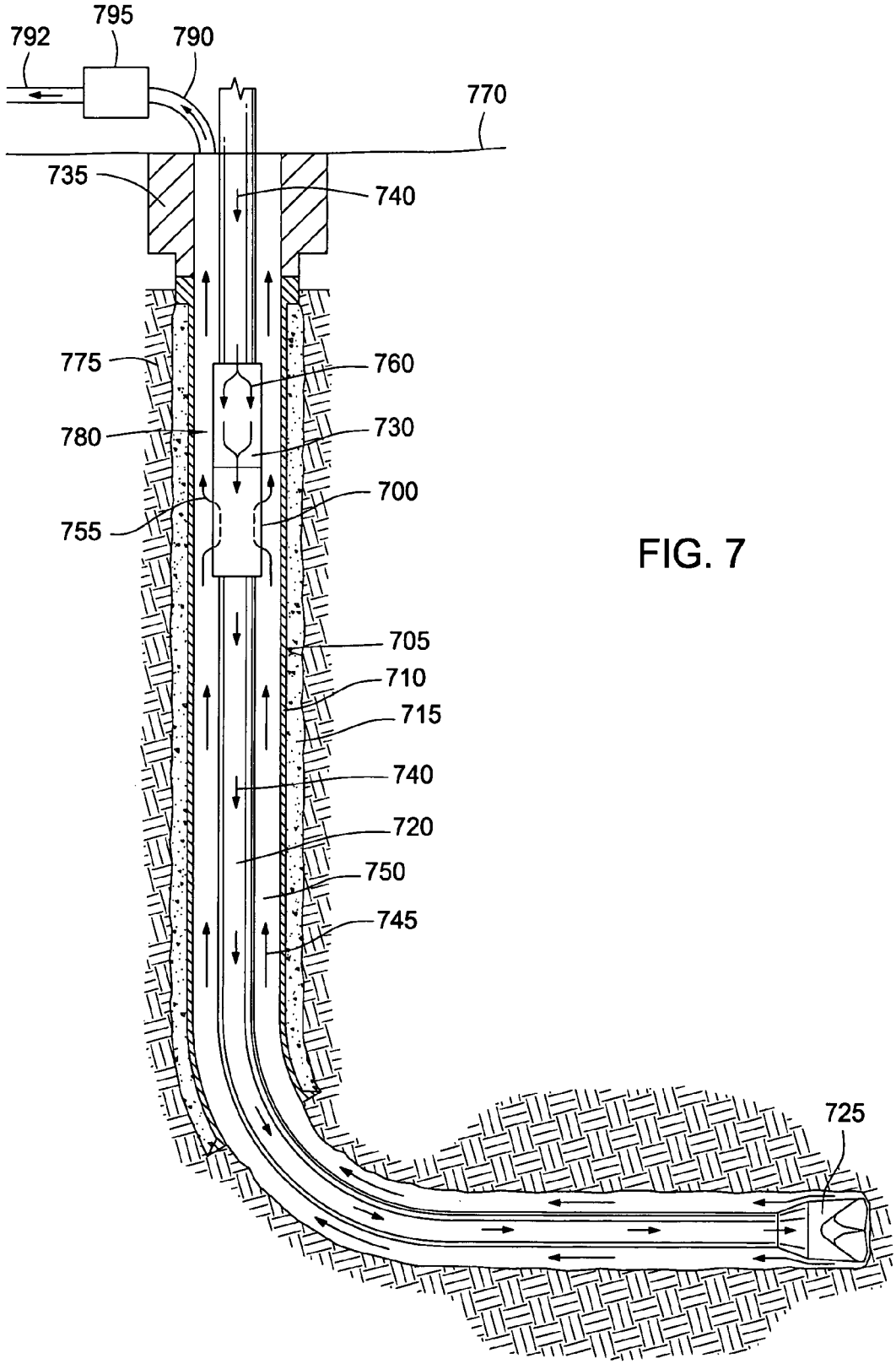
FIG. 7 is a sectional view of a first embodiment of a pressure control apparatus including a surface choke and an ECD reduction tool.

In one embodiment shown in FIG. 7, the wellbore pressure profile is tailored by providing a lifting point at or near the bottom of the wellbore and a choking point, including a choke and a pump, at or near the top of the wellbore. An ECD reduction tool or gas lifting point is placed in the wellbore at a depth above an area of interest in the hydrocarbon-bearing formation, and the return drilling fluid is choked or backpumped at the surface annulus return fluid flow stream. The area of interest may include a portion of the formation capable of bearing hydrocarbons.

FIG. 7 shows a wellbore 705 including a central and a horizontal portion. To strengthen and isolate the wellbore 705 from the surrounding earth formation 775, a portion of the wellbore 705 is lined with casing 710 and an annular area between the casing 710 and the earth formation 775 is preferably at least partially filled with a physically alterable bonding material such as cement 715. At a lower end of the central wellbore, the casing 710 terminates, and the horizontal portion of the wellbore 705 is an "open hole" portion. The wellbore 705 in the alternative may be an entirely open hole wellbore during the drilling using the embodiments of the present invention. Also alternately, the wellbore 705 may be a purely horizontal, vertical, or deviated wellbore.

Coaxially disposed in the wellbore 705 is a drill string 720 made up of one or more tubulars having an earth removal member such as a drill bit 725 operatively connected to a lower end thereof. The drill bit 725 may rotate at the end of the drill string 720 to form the wellbore 705, and rotational force is either provided at a surface 770 of the wellbore 705 or by a mud motor (not shown) located in the drill string 720 proximate to the drill bit 725. A wellhead 735 may be located near the surface 770 and include the drill string 720 disposed therethrough.

As illustrated with arrows, a fluid path 740 includes drilling fluid or "mud" circulated down the drill string 720 which exits from the drill bit 725. The fluid 740 typically provides lubrication for the drill bit 725, means of transport for cuttings to the surface 770, and a force against the sides of the open hole portion of the wellbore 705 to attempt to keep the well in control and prevent wellbore fluids from entering the wellbore 705 before the well is completed. A fluid return path 745 is also illustrated with arrows and represents a return path of the fluid from the bottom of the wellbore 705 to the surface 770 via an annular area 750 formed between the outer diameter of the drill string 720 and the walls of the wellbore 705 (and the inner diameter of the casing 710).

Disposed on the drill string 720 and shown schematically in FIG. 7 is an ECD reduction tool 780 including a motor 730 and a pump 700. The ECD reduction tool 780 is preferably placed in the wellbore 705 above an area of interest in the formation 775. The purpose of the motor 730 is to convert hydraulic energy into mechanical energy and the purpose of the pump 700 is to act upon circulating fluid in the annulus 750 and provide energy or lift to the fluid flowing through the annulus 750 in order to reduce the pressure of the fluid in the wellbore 705 below the pump 700. As shown, fluid traveling down the drill string 720 travels through the motor 730 and causes a shaft therein (not shown) to rotate as shown with arrows 760. The rotating shaft is mechanically connected to and rotates a pump shaft (not shown). Fluid 745 flowing upwards in the annulus 750 is directed into an area of the pump to form fluid flow path 755 which flows between a rotating rotor and a stationary stator. In this manner, the pressure of the circulating fluid is reduced in the wellbore 705 below the pump 700 as energy is added to the upwardly-moving fluid 745 by the pump 700.

Fluid or mud motors are well known in the art and utilize a flow of fluid to produce a rotational movement. The motor may be hydraulic, electric, or of any other form of power source to drive an axial flow pump. Fluid motors can include progressive cavity pumps using concepts and mechanisms taught by Moineau in U.S. Pat. No. 1,892,217, which is incorporated by reference herein in its entirety. A typical motor of this type has two helical gear members wherein an inner gear member rotates within an outer gear member. Typically, the outer gear member has one helical thread more than the inner gear member. During the rotation of the inner gear member, fluid is moved in the direction of travel of the threads. In another variation of motor, fluid entering the motor is directed via a jet onto bucket-shaped members formed on a rotor. Such a motor is described in International Patent Application No. PCT/GB99/02450, which is incorporated by reference herein in its entirety. Regardless of the motor design, the purpose is to provide rotational force to the pump 700 therebelow so that the pump 700 will affect fluid traveling upwards in the annulus 750.

The operation and physical make-up of embodiments of the ECD reduction tool 780, specifically the pump 700 and the motor 730, are more specifically described in co-pending U.S. Patent Application Publication No. 2003/0146001 entitled "Apparatus and Method to Reduce Fluid Pressure in a Wellbore" and filed May 28, 2002, which is herein incorporated by reference in its entirety. Particularly, an exemplary motor for use with the ECD reduction tool 780 is shown and described in relation to FIGS. 2A-2B of the aforementioned patent application, while an exemplary pump for use with the ECD reduction tool 780 is shown and described in relation to FIGS. 2C-2D and FIG. 3 of the application. Instead of the ECD reduction tool shown and described in FIGS. 1-3 of the aforementioned patent application, it is also contemplated that the alternative embodiment ECD reduction tool shown and described in relation to FIG. 4 of the above-incorporated patent application may be used with the embodiments of the present application. Any of the mentioned embodiments in U.S. Patent Application Publication No. 2003/0146001 of the ECD reduction tool, motor, and/or pump may be utilized with embodiments of the present invention.

At the surface 770 of the wellbore 705 is a surface choking mechanism 795. The surface choking mechanism 795 may include any mechanism which is capable of choking (creating a back-pressure on) return fluid flow up through the annulus 750, including but not limited to the choking mechanisms shown and described in relation to U.S. Patent Application No. 2003/0079912 entitled "Drilling System and Method" and filed Oct. 2, 2002 or PCT Application International Publication Number WO 03/071091 entitled "Dynamic Annular Pressure Control Apparatus and Method" and filed Feb. 19, 2003, both of which applications are herein incorporated by reference in their entirety. The surface choking mechanism 795 is capable of selectively providing fluid backpressure to the return drilling fluid stream flowing up through the annulus 750. A return fluid pipe 790 fluidly connects the annulus 750 to the surface choking mechanism 795, and an exiting fluid pipe 792 provides a fluid flow path out from the surface choking mechanism 795 for fluid expended from the surface choking mechanism 795. The circulating system at the surface 770 which may be utilized with the surface choking mechanism 795 may be a closed-loop system as shown and described in the above-incorporated applications US 2003/0079912 or WO 03/071091 and may include any of the components shown and described in the applications, alone or in combination, which may be operated as described in the applications.

In operation, drilling fluid 740 is introduced into the drill string 720 from the surface 770. Upon downward flow through the drill string 720, the fluid 740 is rotated within the motor 730 to convert the fluid pressure into mechanical energy for powering the pump 700. The fluid 740 then flows through the pump 700 and through the portion of the drill string 720 below the pump 700, then out through the drill bit 725. The drilling fluid 740 then conveys cuttings from the formation 775 and possibly other debris existing within the wellbore 705 up through the annulus 750 via return fluid path 745. The return fluid path 745 is detoured through the pump 700, as shown by arrows 755, so that the pump 700 is used to selectively provide energy or lift to the fluid 745 flowing up through the annulus 750 in order to reduce the pressure of the fluid in the wellbore 705 below the pump 700.

The return fluid path 745 exits the wellbore 705 through the return fluid pipe 790. The surface choking mechanism 795 may be utilized at any time to provide backpressure (add pressure) to the return fluid path 745 flowing up through the annulus 750. Therefore, the surface choking mechanism 795 and the ECD reduction tool 780 may be utilized alternately and/or together to reduce and/or increase fluid pressure within the wellbore 705 to control pressure within various portions of the wellbore 705. The fluid exiting the surface choking mechanism 795 flows through the exiting fluid pipe 792 and may optionally be treated and recycled back into the drill string 705.

In an embodiment, the pressure control mechanisms (the ECD reduction tool 780 and the surface choking mechanism 795) as shown and described in FIG. 7 are used to create an adjustable high pressure region above the area of interest in the formation for well control and a low pressure, wellbore pressure region at or near the area of interest in the formation consistent with formation pressure. The high pressure region is created by the choked fluid flow produced by the operation of the surface choking mechanism 795, while the low pressure region is produced by the operation of the ECD reduction tool 780 (or other fluid lifting device). This preferred embodiment would allow the use of a heavier drilling fluid than is typically utilized when only surface choking is employed to control wellbore pressure, while at the same time allowing use of a lighter drilling fluid than is typically utilized when only an artificial lift mechanism is employed downhole adjacent the area of interest. The preferred embodiment wellbore fluid system is capable of more closely tailoring the wellbore pressure to control the well without the potential for formation damage.

In other embodiments illustrated in FIG. 8-9, the lifting point and the choking point of the fluid are placed downhole with the choking point below the lifting point to allow maintenance of a wellbore pressure profile. The embodiment shown in FIG. 8 includes a downhole choke strategically placed within a bore of a drill string below an ECD reduction tool. The downhole choke creates fluid flow restriction between the outside of the drill string and the inside of the casing.

Figure 8:
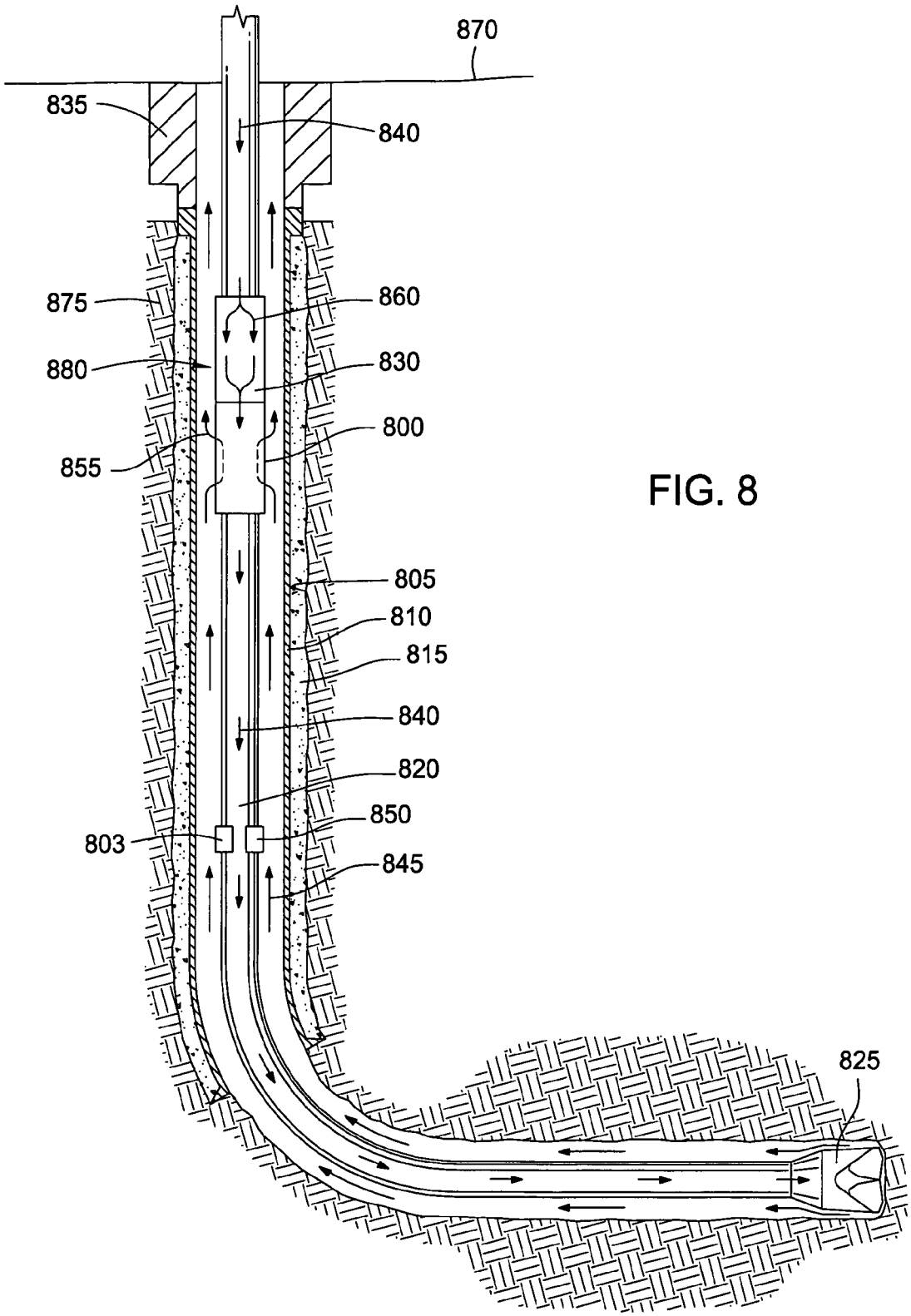
FIG. 8 is a sectional view of a second embodiment of a pressure control apparatus including a downhole choke within a drill string and an ECD reduction tool.

The majority of the components shown in FIG. 8 are substantially similar in structure and operation to the components shown and described in relation to FIG. 7; therefore, the description above relating to the components having numbers in the "700" series also relates to components having numbers in the "800" series of FIG. 8. The difference between the embodiments in FIGS. 7 and 8 is that a downhole choke 803, which is provided in the form of a restriction between the outside of the drill string and the inside of the casing in FIG. 8, is utilized instead of the surface choking mechanism 795 of FIG. 7. The downhole choke 803 may also be completely closed to function as a downhole fluid flow barrier in the event of a well control issue.

The downhole choke 803 is preferably included on the outside of the drill string 820 at some point below the ECD reduction tool 880; however, the downhole choke 803 may in the alternative be included above the ECD reduction tool 880 on the outside of the drill string 820. The downhole choke 803 may be adjustable to increase or decrease the amount of flow restriction within the annulus. The downhole choke 803 may be adjusted using any suitable communication mechanism including mud pulse, pressure, flow, electrical signal, ball drop, or manipulation of the pipe string.

In operation, the downhole choke 803 acts to increase the fluid pressure before the downhole choke 803 within the drill string 820 by providing backpressure before the location of the downhole choke 803 while at the same time reducing fluid pressure after the downhole choke 803. The ECD reduction tool 880 reduces fluid pressure of the return fluid 845 in the annulus portion below the ECD reduction tool 880. This embodiment would allow a relatively heavy drilling fluid system to be used, while at the same time facilitating well control by the hydrostatic pressure of the fluid.

Figure 9:
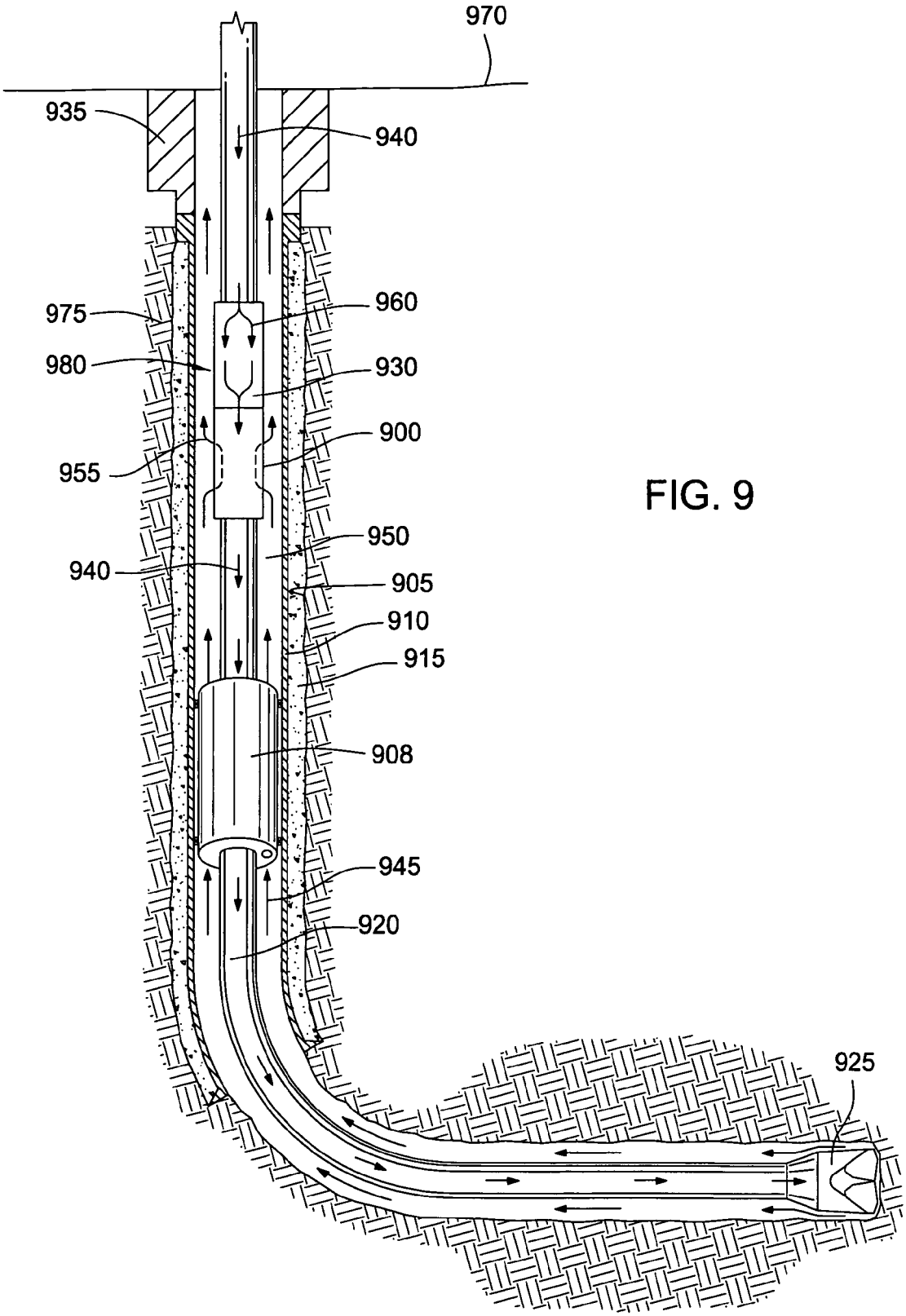
FIG. 9 is a sectional view of a third embodiment of a pressure control apparatus including an annular downhole choke disposed below an ECD reduction tool.

The embodiment shown in FIG. 9 provides a downhole choke strategically placed on an outer diameter of a drill string below an ECD reduction tool. As mentioned above in relation to FIG. 8, the majority of the components shown in FIG. 9 are substantially similar in structure and operation to the components shown and described in relation to FIG. 7; therefore, the description above relating to the components having numbers in the "700" series also relates to components having numbers in the "900" series of FIG. 9. The difference between the embodiments shown in FIGS. 7 and 9 is that a downhole choke 908, which is provided in the form of a downhole choke within the annulus between the drill string and the wellbore wall in FIG. 9, is utilized instead of the surface choking mechanism 795 of FIG. 7.

The downhole choke 908 may include the downhole choke 110 as shown and described in relation to FIG. 1, which is the downhole choke shown in FIG. 9. In the alternative, downhole chokes usable in the embodiment of FIG. 9 also include the downhole chokes 260, 270, 392 as shown and described in relation to FIG. 2, FIG. 2A, FIG. 2B, FIG. 2C, or FIG. 3. Broadly, the downhole choke 908 exists around the outer diameter of the drill string 920 to provide backpressure to fluid flowing up through the annulus 950. In the embodiment shown in FIG. 9, the downhole choke 908 is located below the ECD reduction tool 980 on the drill string 920.

In operation, the downhole choke 908 is capable of increasing pressure within the portion of the wellbore 905 upstream of the downhole choke 908, while the ECD reduction tool 980 is then capable of decreasing the fluid pressure within the entire portion of the wellbore 905 upstream of it. Similar to the embodiment of FIG. 8, this embodiment would allow a relatively heavy drilling fluid system to be used, while at the same time facilitating well control by the hydrostatic pressure of the fluid above the lifting point.

Figure 10:
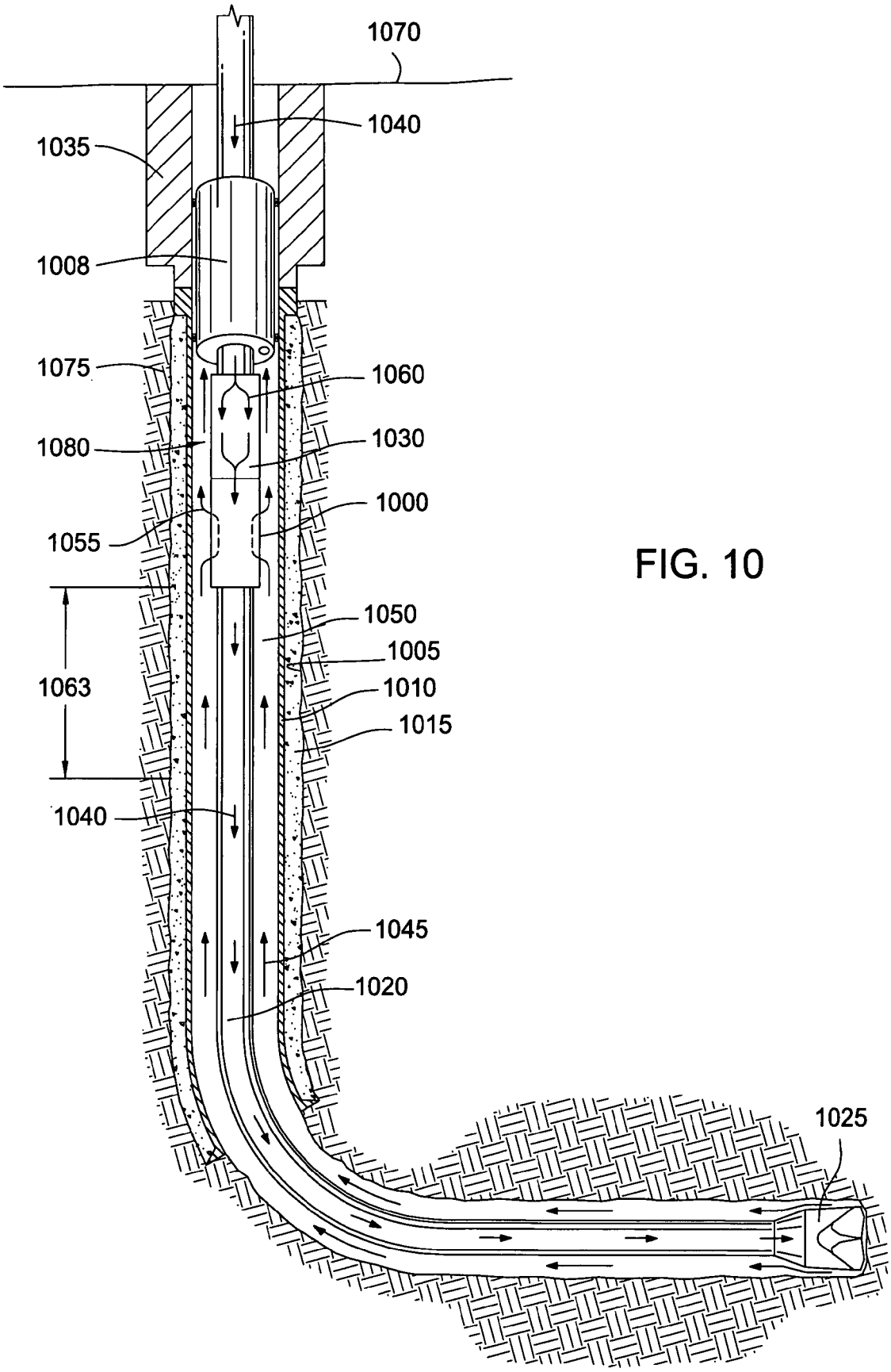
FIG. 10 is a sectional view of a fourth embodiment of a pressure control apparatus including an annular downhole choke disposed above an ECD reduction tool.

An additional embodiment shown in FIG. 10 involves placing both the lifting point and the choking point of the fluid downhole, the choking point existing above the lifting point, to maintain the desired wellbore pressure profile. The downhole choke 1008 is shown on the outer diameter of the drill string 1020 in FIG. 9 and is shown as the downhole choke 110 shown and described in relation to FIG. 1. In an alternate embodiment, the downhole choke may include any of the downhole chokes 260, 270, 392 as shown and described in relation to FIG. 2, FIG. 2A, FIG. 2B, FIG. 2C, or FIG. 3.

Because the majority of the components shown in FIG. 10 are substantially similar in structure and operation to the components shown and described in relation to FIG. 7, the description above relating to the components having numbers in the "700" series of FIG. 7 also relates to components having numbers in the "1000" series of FIG. 10. The choking mechanism of FIG. 10 is, however, located downhole within the wellbore 1005 and above the ECD reduction tool 1080 in the drill string 1020.

Figure 11:
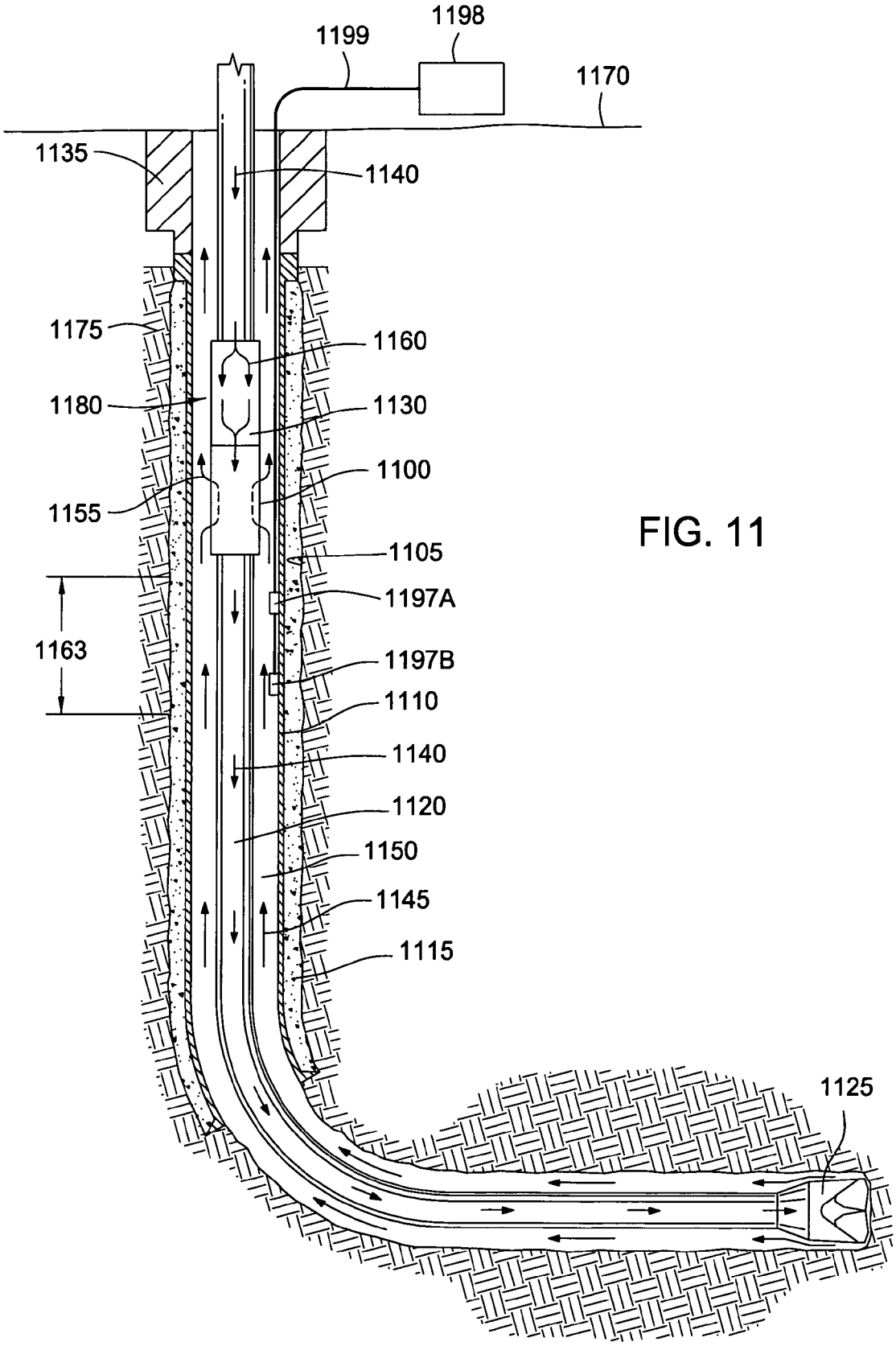
FIG. 11 is a sectional view of a fifth embodiment of a pressure control apparatus including a combination ECD reduction tool/downhole choke.

In a further alternate embodiment depicted in FIG. 11, an ECD reduction tool may be utilized as a combination lifting device and choking device. The majority of the components shown in FIG. 11 are substantially similar in structure and operation to the components shown and described in relation to FIG. 7; therefore, the description above relating to the components having numbers in the "700" series also relates to components having numbers in the "1100" series of FIG. 11. The difference is that in FIG. 11, a combination ECD reduction tool/choke 1180 performs both of the functions of lifting the fluid and choking the fluid, as needed.

Optionally, the combination ECD reduction tool/choke 1180 could interface with one or more real time formation pressure sensors 1197A, 1197B and automatically adjust the function of the ECD reduction tool/choke 1180 (lifting to decrease fluid pressure below the tool 1180 or choking to increase fluid pressure below the tool 1180) to maintain proper drilling fluid pressure within the annulus 1150 adjacent to an area of interest 1163 in a formation 1175. The sensors 1197A, 1197B may include any type of pressure-sensing devices, including but not limited to optical sensors. The sensors may also be of types for sensing other downhole parameters such as temperature, flow rate, or mass flow. Further, the sensors may include tools for sensing geophysical parameters such as inclination, orientation, or formation characteristics.

Construction and operation of an optical sensor suitable for use with the present invention, in the embodiment of an FBG sensor, is described in the U.S. Pat. No. 6,597,711 issued on Jul. 22, 2003 and entitled "Bragg Grating-Based Laser", which is herein incorporated by reference in its entirety. Each Bragg grating is constructed so as to reflect a particular wavelength or frequency of light propagating along the core, back in the direction of the light source from which it was launched. In particular, the wavelength of the Bragg grating is shifted to provide the sensor.

Another suitable type of optical sensor for use with the present invention is an FBG-based inferometric sensor. An embodiment of an FBG-based inferometric sensor which may be used as an optical sensor of the present invention is described in U.S. Pat. No. 6,175,108 issued on Jan. 16, 2001 and entitled "Accelerometer Featuring Fiber Optic Bragg Grating Sensor for Providing Multiplexed Multi-axis Acceleration Sensing," which is herein incorporated by reference in its entirety. The inferometric sensor includes two FBG wavelengths separated by a length of fiber. Upon change in the length of the fiber between the two wavelengths, a change in arrival time of light reflected from one wavelength to the other wavelength is measured. The change in arrival time indicates the wellbore or formation parameter (e.g., pressure).

The one or more sensors 1197A, 1197B communicate via a cable 1199 with a surface monitoring and control unit ("SMCU") 1198 located at the surface 1170 or at some remote location away from the wellbore 1105. The cable 1199 may be an optical waveguide (as described in the two incorporated references immediately above) or a conductor cable. The SMCU 1198 receives communication from the sensors 1197A, 1197B of the pressure at or near the sensor location via the cable 1199 and is capable of processing the communication and sending one or more signals through a cable or by wired pipe (see below) to operate the ECD reduction tool/choke 1180 to increase or decrease the pressure in the wellbore 1105. The operation of the control system may be automatic or semi-automatic.

The ECD reduction tool/choke 1180 preferably exists above the area of interest 1163 to allow adjustment of the drilling fluid pressure according to the sensed information. The ability to control wellbore pressure at or near the area of interest 1163 aids in preventing damage to the formation 1175 resulting from over-pressurized drilling fluid.

In an alternate embodiment, the combination ECD reduction tool/choke 1180 of FIG. 11 may be replaced with a different pressure control mechanism, such as a positive displacement pump. The positive displacement pump is then run faster or slower depending on real time pressure requirements, preferably determined by the sensing and control system.

One or more aspects of any of the embodiments shown and described in relation to FIGS. 7-11 (and FIGS. 1-6 described above and FIGS. 12-15A described below as well) may be combined to create custom wellbore profiles so that the slope of the pressure gradient and/or the scalar value of the pressure gradient may be varied as desired along one or more given intervals within the wellbore. Multiple choking points and/or lifting points may be utilized at various locations within the wellbore and/or at the surface to create the desired wellbore profile along intervals. That is, one or more ECD reduction tools, choking mechanisms, separators, and/or lighter drilling fluids may be utilized within the wellbore to tailor the pressure within the wellbore to a given value in a given area within the wellbore.

Additionally, any of the above embodiments shown and described in relation to FIGS. 7-11 (and FIGS. 1-6 described above and FIGS. 12-15A described below as well) may be supplemented with real-time downhole pressure sensing, as shown and described in relation to FIG. 11, to control and adjust the appropriate pressure control devices (choking, lifting/pumping devices, fluid flow rates, and/or downhole separators). The sensor(s) may be placed at any portion of the wellbore at which it is desired to determine and control wellbore pressure, including at a location near the area of interest in the formation. The sensor(s) could be automated or semi-automated for adjustment of the pressure control device(s) using appropriate algorithm and micro-processing equipment. The sensor(s) could be used in conjunction with any telemetry system, including but not limited to electromagnetic telemetry, an example of which is shown and described in co-pending U.S. Patent Application Publication No. 2004/0084189 entitled "Instrumentation for a Downhole Deployment Valve" and filed Nov. 5, 2002, which is herein incorporated by reference in its entirety, or wired drill pipe, the operation and construction of an example of which is shown and described in co-owned U.S. Pat. No. 6,655,460 entitled "Methods and Apparatus to Control Downhole Tools" and filed on Oct. 12, 2001, which is also incorporated herein by reference in its entirety.

Any of the above embodiments shown and described in relation to FIGS. 7-11 (and FIGS. 1-6 described above and FIGS. 12-15A described below as well) may be utilized, alone or in combination with aspects of one another, in conjunction with a continuous circulating chamber, for example the continuous circulating chamber shown and described in co-pending U.S. Patent Application Publication No. 2002/0157838 entitled "Continuous Circulation Drilling Method" and filed Nov. 13, 2001, which is herein incorporated by reference in its entirety, and related documents and patent applications referenced in the aforementioned patent application, which are also herein incorporated by reference in their entirety. Use of a continuous circulating chamber with any of the embodiments of the present invention allows chosen dynamic annular pressure profiles to be maintained during make-up and/or break-out of the joints of the drill pipe used in the drill string so that managed pressure drilling may be carried out as a closed-loop drilling system, making managed pressure drilling possible from make-up of the drill string to pulling of the drill string from the wellbore. Any of the embodiments described herein may be used with surface data processing and control systems such as those described in U.S. Patent Application Publication No. 2003/0079912, which is incorporated by reference herein in its entirety.

Figure 12A:
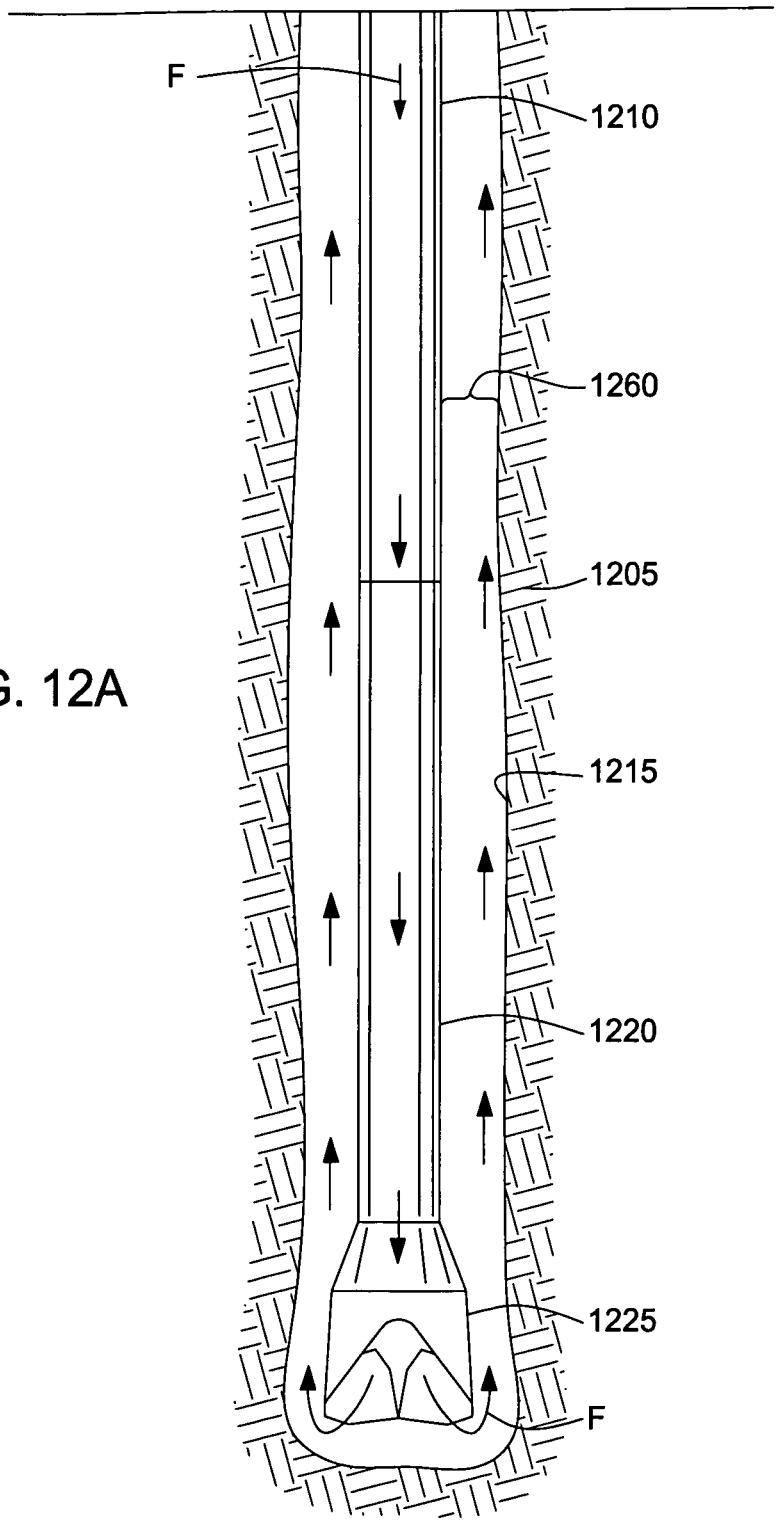
FIG. 12A is a sectional view of a drill string drilling a wellbore using a running string.
Figure 12B:
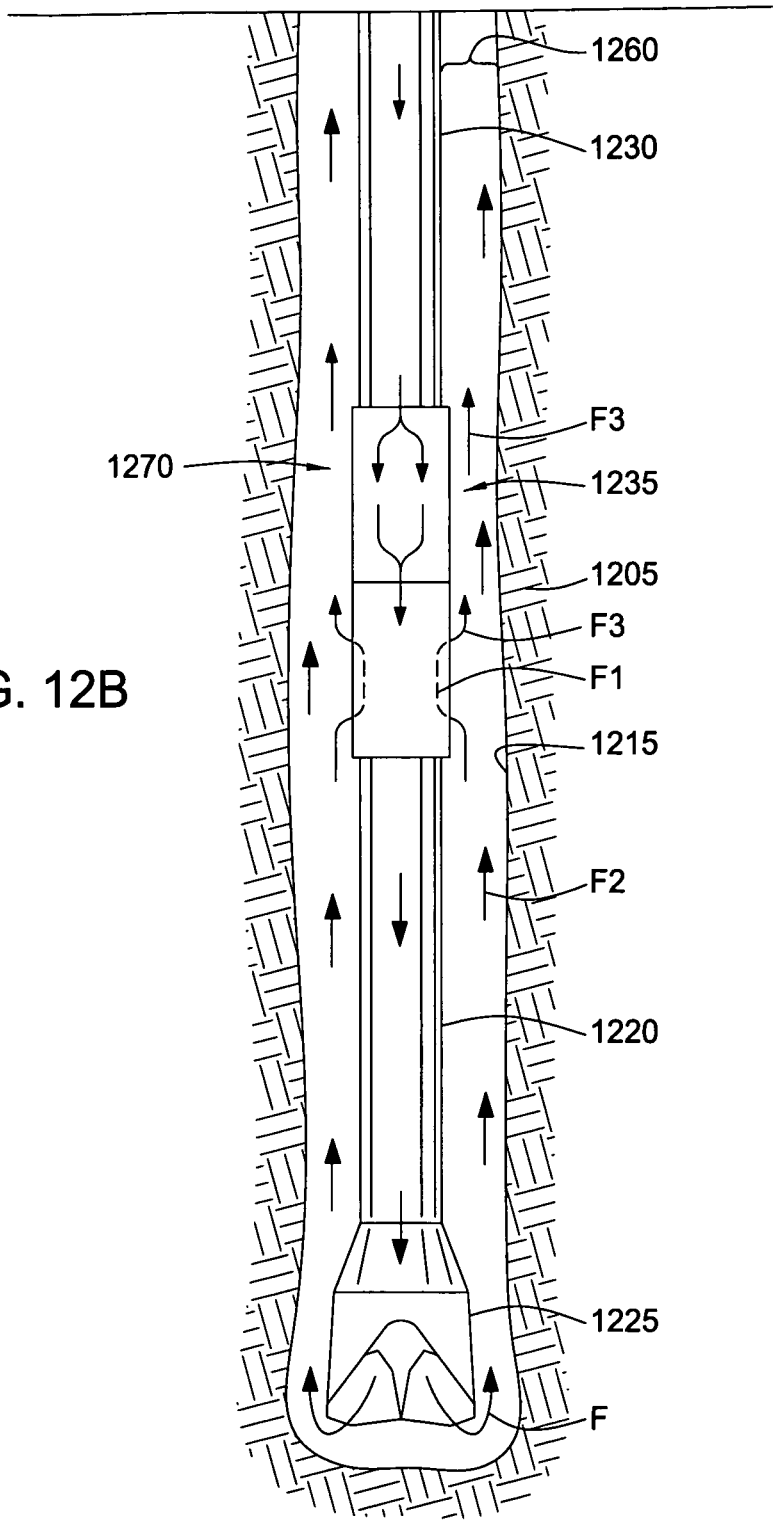
FIG. 12B is a sectional view of a first embodiment of a differential sticking reduction tool including an ECD reduction tool operatively connected to the drill string of FIG. 12A.

FIGS. 12A-B, 13A-B, and 14 show embodiments of a differential sticking remediation tool which eliminate the need for traditional jarring or fishing of the drill string when the drill string differentially sticks within a wellbore. FIGS. 12A-B show a differential sticking remediation tool 1270 selectively run into a wellbore 1215 formed in an earth formation 1205 by a drill string 1220.

A typical drilling operation is shown in FIG. 12A. A portion of the wellbore 1215 is drilled using the drill string 1220 by an earth removal member such as a drill bit 1225. The drill bit 1225 is preferably operatively connected to a lower end of the tubular body of the drill string 1220, and the drill bit 1225 includes one or more perforations therethrough for circulating drilling fluid F within the wellbore 1215. The drill bit 1225 may optionally be a part of a bottomhole assembly (not shown) which may include a mud motor or some other type of downhole motor, one or more stabilizers and/or centralizers, or other well-known components of a bottomhole assembly.

A running string 1210 is used to manipulate the drill string 1220 from a surface of the wellbore 1215 as well as to convey drilling fluid F into the drill string 1220 from the surface. A lower end of the running string 1210 is operatively connected, preferably threadedly connected, to an upper end of the drill string 1220.

Illustrated in FIG. 12B is an embodiment of a differential sticking remediation tool 1270 of the present invention operatively connected to the drill string 1220. The differential sticking remediation tool 1270 includes an ECD reduction tool tubular string 1230 having an ECD reduction tool 1235 therein. The ECD reduction tool 1235 may be the ECD reduction tool shown and described in relation to FIGS. 7-11 above. The ECD reduction tool 1235 may include any type of energy transfer assembly capable of adding energy to upwardly traveling fluid in an annulus 1260 between the wall of the wellbore 1215 and the tubular string including the drill string 1220 and the ECD reduction tool tubular string 1230. The ECD reduction tool 1235 may also include any type of energy transfer assembly which transfers energy from fluid F pumped down the drill string 1220 to fluid circulating upwards in the annulus 1260. The ECD reduction tool 1235 is capable of transferring energy between the interior of the tubular string and the exterior of the tubular string, and may be in communication with a power source (not shown) for providing operating power to the tool 1235. The ECD reduction tool takes the weight of the fluid off of the bottom of the wellbore and transfers the weight to the hook.

In operation, a typical drilling operation is carried out by drilling into the formation 1205 to form a wellbore 1215 using the drill string 1220 and the running string 1210, as shown in FIG. 12A. Drilling fluid F is introduced into a longitudinal bore within the running string 1210 from the surface in a typical circulating operation to make way for the drill bit 1225 through the formation 1205 and to remove cuttings from the wellbore 1215. The fluid F flows down the bore of the running string 1210, down through the longitudinal bore of the drill string 1220, out through perforation(s) in the drill bit 1225, and up the annulus 1260 to the surface of the wellbore 1215.

Upon differential sticking of the drill string 1220 within the wellbore 1215 due to undesirable pressure distribution within the wellbore 1215, the drilling with the drill string 1220 is temporarily halted. The running string 1210 is selectively released from its operative connection to the drill string 1220 and removed from the wellbore 1215. In the embodiment shown in FIG. 12A, the running string 1210 is unscrewed from its threaded connection with the drill string 1220. The lower end of the ECD reduction tool tubular string 1230 is then operatively connected to the upper end of the drill string 1220, as shown in FIG. 12B. The ECD reduction tool 1235 is preferably added to the tubular string when the drill string 1220 reaches a depth of approximately 1000 to approximately 2000 feet within the wellbore 1215.

Subsequent to placing the ECD reduction tool 1235 within the tubular string, drilling fluid F is again circulated down through the ECD reduction tool tubular string 1230, down through the drill string 1220, and up through the annulus 1260. Because of the operation of the ECD reduction tool 1235, fluid F traveling up through the annulus 1260 follows two paths, with the fluid F1 flowing into the ECD reduction tool 1235 and back out into the annulus 1260 after energy has been added to the fluid, and with the fluid F2 flowing upward through the annulus 1260. The fluid paths F1 and F2 meet in the annulus 1260 to form fluid path F3. The energy added to the fluid path F3 and the relief from the high pressure downhole aids in alleviating the differential sticking of the drill string 1220.

After removal of the differential sticking of the drill string 1220 within the wellbore 1215, the ECD reduction tool tubular string 1230 may be removed from the wellbore 1215 by disconnection from the drill string 1220, and the running string 1210 may again be operatively connected to the drill string 1220 for drilling of the wellbore 1215 to a further depth. In the alternative, the drill string 1220 and the ECD reduction tool tubular string 1230 may both be removed from the wellbore 1215.

In an alternate embodiment, the operative connection between the drill string 1220 and the ECD reduction tool tubular string 1230 of FIGS. 12A-B is a latching mechanism so that the ECD reduction tool 1235 may simply be latched into the drill string 1220 when differential sticking occurs.

In a further alternative embodiment, the ECD reduction tool 1235 of FIGS. 12A-B may remain in the drill string 1220 during drilling as an insurance policy against differential sticking. In this embodiment, the ECD reduction tool 1235 is not functional until differential sticking occurs. During normal drilling operations (absent differential sticking), the ECD reduction tool 1235 is in tension. When differential sticking exists, the ECD reduction tool 1235 may be activated by a combination of overpull and fluid flow. The ECD reduction tool 1235 is thus selectively activated downhole.

Figure 13A:
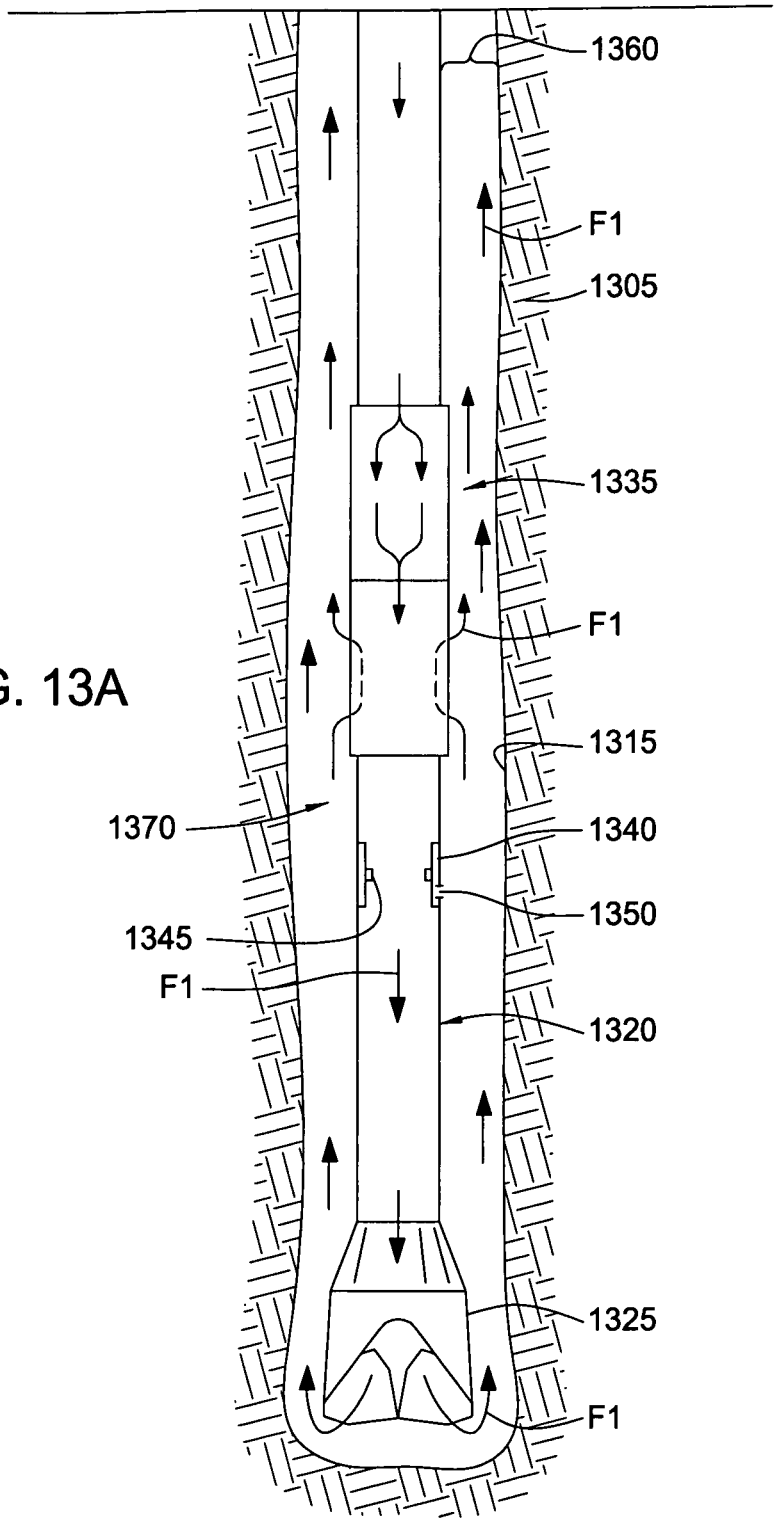
FIG. 13A is a sectional view of a second embodiment of a differential sticking reduction tool including an ECD reduction tool disposed within a drill string and an inner diameter restriction located in the drill string below the ECD reduction tool.
Figure 13B:
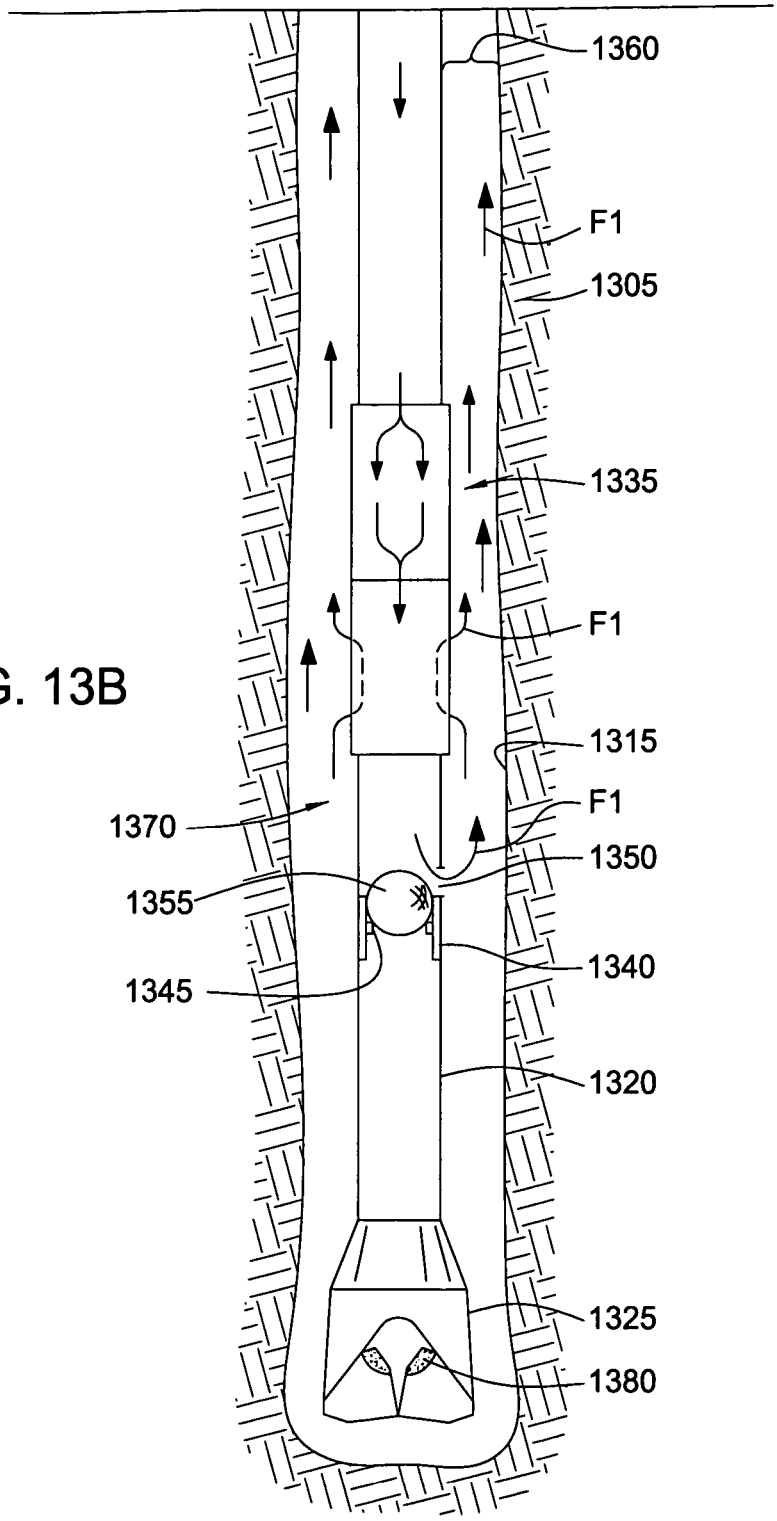
FIG. 13B is a sectional view of the differential sticking reduction tool of FIG. 13A. A shifting member shifts the inner diameter restriction, thereby allowing fluid flow through one or more bypass ports within a wall of the drill string.

FIGS. 13A-B show an alternate embodiment of a differential sticking remediation tool 1370. In this embodiment, an ECD reduction tool 1335 alleviates pressure within a wellbore 1315 and lifts hydrostatic head even when fluid flow through a portion of the drill string 1320 (e.g., a portion of the bottomhole assembly, such as the drill bit 1325) is blocked. Fluid flow through the drill bit 1325 or the bottomhole assembly may be blocked by a buildup of cuttings produced from drilling into the formation 1305, among other things.

FIG. 13A shows the differential sticking remediation tool 1370, which may include a tubular body having the pressure reduction tool operatively connected to a drill string (not shown) or may include the drill string 1320 and the pressure reduction tool. In the embodiment shown, the drill string 1320 includes an ECD reduction tool 1335 therein. The ECD reduction tool 1335 may be the same as the ECD reduction tools of FIGS. 7-11. The drill string 1320 further includes a drill bit 1325 (or some other earth removal member) operatively connected to its lower end having one or more perforations therethrough for circulating fluid within the wellbore 1315.

Disposed within the drill string 1320 is a sleeve 1340 capable of sliding within the drill string 1320 to selectively cover or uncover one or more bypass ports 1350 formed through the wall of a portion of the drill string 1320. Extending inwardly from the sleeve 1340 is a drill string inner diameter restriction having a profile 1345 for a shifting member 1355 such as a ball or a dart (see FIG. 13B) to positively engage upon placement within the bore of the drill string 1320 to accomplish the shifting of the sleeve 1340.

In operation, the differential sticking reduction tool 1370 is used to drill into the formation 1305 to form the wellbore 1315 as shown in FIG. 13A. The ECD reduction tool 1335 operates in substantially the same manner as described above in relation to FIGS. 12A and 12B to reduce hydrostatic head below the ECD reduction tool 1335 and to add fluid flow to the annulus 1360 above the ECD reduction tool 1335. During ordinary operation of the drill string 1320, the sleeve 1340 closes the bypass port 1350, thereby isolating fluid flow through this portion of the drill string 1320 from fluid flow within the annulus 1360. Drilling fluid F flows downward through the drill string 1320 into the ECD reduction tool 1335, then downward through the drill bit 1325 and up through the annulus 1360. The upwardly-flowing drilling fluid F1 flows into the ECD reduction tool 1335 so that the ECD reduction tool 1335 may increase the pressure of the fluid, then the fluid stream F1 exits the ECD reduction tool 1335 to flow up through the annulus above the tool 1335 to the surface.

FIG. 13B illustrates the operation of the differential sticking remediation tool 1370 upon at least partial blockage 1380 at the lower end of the drill string 1320 (e.g., at the drill bit 1325) when the drill string 1320 experiences differential sticking within the wellbore 1315. Upon blockage 1380, because significant fluid flow through the drill bit 1325 cannot occur, little or no fluid flow exists up through the annulus 1360 to flow into the ECD reduction tool 1335 to reduce hydrostatic head therebelow. When blockage 1380 exists, the ball 1355 or some other sleeve-shifting member is introduced into the bore of the drill string 1320, and the ball 1355 eventually rests upon the profile 1345.

Fluid F1 is then added to the bore of the drill string 1320 above the ball 1355. Upon sufficient buildup of fluid pressure within the bore above the ball 1355, the sleeve 1340 is forced to slide downward, thereby uncovering the bypass port(s) 1350. Fluid F1 is now permitted to circulate down through the drill string 1320, out the bypass port(s) 1350, and up through the annulus 1360. The fluid F1 bypasses the drill bit 1325 by traveling through the bypass port(s) 1350.

Fluid F1 then flows through the ECD reduction tool 1335. After the ECD reduction tool 1335 adds pressure to the fluid stream F1, the fluid stream F1 travels up the remainder of the annulus 1360 to the surface of the wellbore 1315. In this way, hydrostatic head within the wellbore 1315 is reduced below the ECD reduction tool 1335. Absent the high amount of hydrostatic head and/or ECD near the drill bit 1325, the drill string 1320 may be un-stuck from the wellbore 1315 by manipulating the drill string 1320 from the surface of the wellbore 1315 to correct the problem of differential sticking.

Figure 14A:
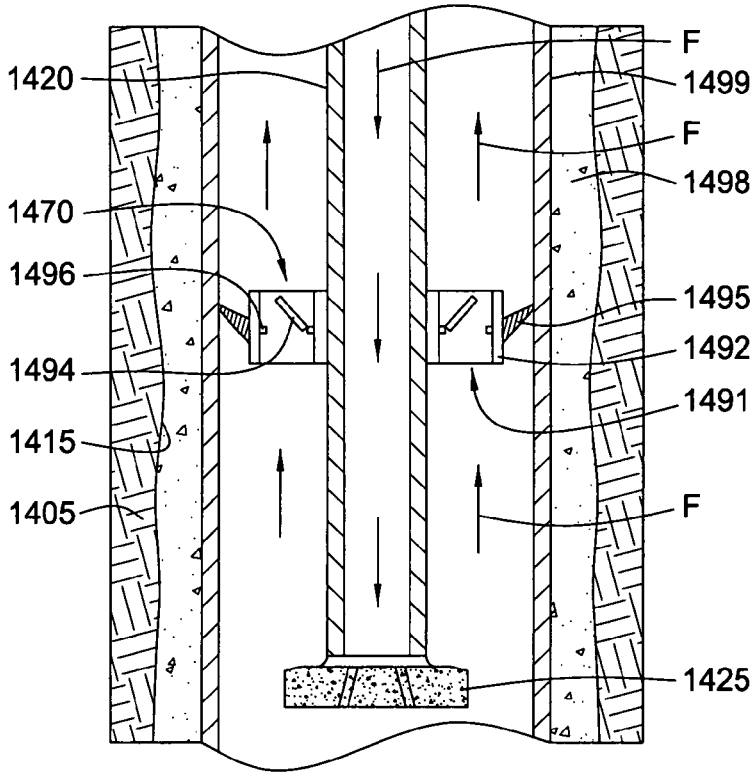
FIG. 14A is a sectional view of a third embodiment of a differential sticking reduction tool drilling into a formation to form a wellbore.
Figure 14B:
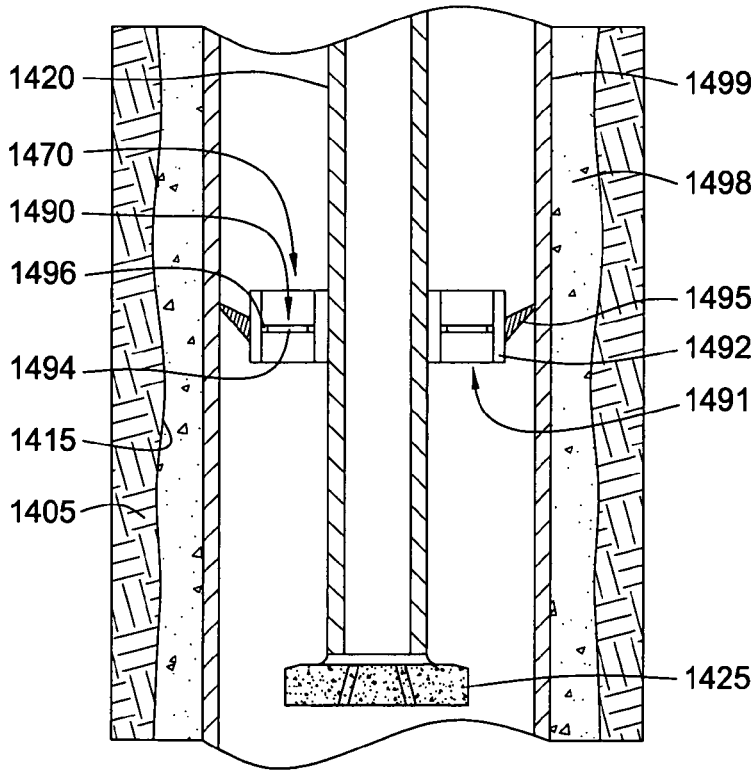
FIG. 14B shows the differential sticking reduction tool of FIG. 14A in position upon differential sticking of the drill string within the wellbore.

Shown in FIGS. 14A-B is a further alternate embodiment of a differential sticking reduction tool 1470. As shown in FIG. 14A, the differential sticking reduction tool 1470 is disposed on the outer diameter of a drill string 1420 having an earth removal member such as a drill bit 1425 operatively connected to its lower end. The drill string 1420 is shown located within casing 1499 set within a wellbore 1415 formed in an earth formation 1405.

The differential sticking reduction tool 1470 includes a body 1492 operatively connected to the outer diameter of the drill string 1420 at a location. One or more annular flow ports 1491 concentrically spaced from one another extend through the body 1492 and include one or more one-way valves such as a flapper valve therein, the flapper valve including a flapper seat 1496 for receiving a flapper 1494 when the flapper valve is in the closed position. As is known by those skilled in the art, the flapper 1494 is biased closed by a spring (not shown) at one end to exist in a hinged relationship relative to the body 1492. Any other type of one-way valve may be utilized instead of a flapper valve, including but not limited to a check valve or a ball valve. The one-way valve prevents fluid flow downward through the one-way valve, but allows fluid flow upward through the one-way valve.

The flapper 1494 is openable upon fluid flow in the upward direction, as the fluid pressure overcomes the bias force of the spring. Opening the flapper 1494 exposes the annular flow port(s) 1491 through the body 1492 which then allow fluid flow therethrough.

A generally concentric swap-type sealing element 1495, such as a swab-type packer cup, extends around an outer diameter of the body 1492 to seal the annulus between the outer diameter of the body 1492 and the inner diameter of the casing 1499 (or the wall of the wellbore 1415 in the case of an open hole wellbore). The sealing element 1495 is preferably formed of an elastomeric material such as rubber and includes one or more upwardly-extending lips which allow sealed downward movement of the drill string 1420 into the wellbore 1415.

In operation, initially referring to FIG. 14A, the drill string 1420 is lowered into the formation 1405 to form a wellbore 1415. While lowering the drill string 1420, a portion of the drill string 1420 or the entire drill string 1420 may be rotated. Drilling fluid F is introduced into a longitudinal bore of the drill string 1420 from the surface of the wellbore 1415.

In the drilling position, shown in FIG. 14A, the drilling fluid travels downward through the bore of the drill string 1420, out the lower end of the drill string 1420 through one or more perforations in the drill bit 1425, and up through the annulus. Upward fluid flow is allowed through the flapper 1494 and causes the flapper 1494 to pivot upward to expose the annular bypass port(s) 1491. While lowering the drill string 1420, the sealing element 1495 provides a sealed relationship between the body 1492 and the casing 1499, and at the same time the upward extension of the sealing element 1495 allows substantially uninhibited downward movement of the drill string 1420. All or at least a substantial amount of the annular flow is diverted through the annular bypass port(s) 1491 during drilling.

While pumping is stopped due to differential sticking or other reasons, the drill string 1420 assumes the position shown in FIG. 14B. Drilling fluid flow through the drill string and device is halted, allowing the annular flow device 1490 to close. The annular flow device 1490 then restricts fluid from traveling freely from above the annular flow device 1490 to below the annular flow device 1490 through the annular bypass port(s) 1491.

A substantially upwardly-directed physical force is then applied to the drill string 1420, causing a portion of the drill string 1420 below the body 1492 to stretch. The stretching of the drill string 1420 lifts the fluid pressure in the portion of the annulus above the annular flow device 1490 off of the formation 1405, thus reducing the differential sticking pressure exerted on the drill string 1420 and freeing the drill string 1420.

Although the embodiments shown and described in relation to FIGS. 12-14 are in the context of alleviating the problem of differential sticking of the drill string, the embodiments of FIGS. 12-14 may be utilized in any situation which warrants reduction of the hydrostatic head or equivalent circulation density within the wellbore. The embodiments shown and described in relation to FIGS. 12-14 merely represent other tools or pressure control mechanisms which may be used in the scheme to manage the pressure within the wellbore in a managed pressure drilling system.

In another embodiment, an apparatus for adjusting fluid pressure downhole within a wellbore comprises a drill string and a downhole choke located on the drill string and disposed within an annulus between the outer diameter of the drill string and a wall of the wellbore. The downhole choke includes an annular restriction and a longitudinal bore therethrough, wherein a diameter of the longitudinal bore is adjustable when the downhole choke is downhole to alter fluid pressure within the wellbore. In another embodiment, the location of the downhole choke on the drill string is adjustable downhole. In yet another embodiment, the apparatus further comprises an equivalent circulation density tool located in the drill string to transfer energy from drilling fluid flowing down through the drill string to fluid circulating up through the annulus. In yet another embodiment, the ECD tool comprises a pump for lifting the fluid up through the annulus. In yet another embodiment, ECD tool is located on the outer diameter of the drill string and comprises one or more selectively operable valves and one or more sealing elements, wherein the selectively operable valves and the sealing elements cooperate to at least substantially seal the annulus in the absence of appreciable flow. In yet another embodiment, the longitudinal bore is adjustable downhole to at least substantially prevent fluid flow through the annulus.

In another embodiment, a method of removing differential sticking within a wellbore in an earth formation comprises forming the wellbore using a drill string; selectively connecting an energy transfer device to the drill string downhole upon differential sticking of the drill string within the wellbore; and operating the energy transfer device to transfer energy from drilling fluid pumped down the drill string to fluid circulating upwards in an annulus between an outer diameter of the drill string and a wellbore wall, thereby removing the differential sticking. In another embodiment, the method further comprises removing the energy transfer device from the wellbore and drilling further into the formation using the drill string.

All of the above embodiments shown in FIGS. 1-14 provide managed pressure drilling throughout the wellbore. Any of the embodiments shown and described above may be utilized in conjunction with one another to allow managing of the pressure at various positions within the wellbore while drilling. Using any of the embodiments shown and described above, alone or in combination with one another, permits numerous applications when drilling a wellbore. The pressure of drilling fluid within the well may be maintained so that drilling fluid does not invade the formation. Furthermore, formation pressure may be controlled by drilling fluid pressure so that formation fluids do not flow uncontrolled into the wellbore to possibly cause a kick or blowout of the well at the surface of the earth. Therefore, drilling fluid pressure may be maintained at a value below the formation fracture pressure. Preferably, dynamic drilling operations are carried out using a drilling fluid which is approximately equal to, but not above, formation pressure in the region of the formation. The above embodiments allow controlling of the drilling fluid pressure at various regions downhole within the wellbore rather than merely at the surface of the wellbore so that formation fluids may be consistently pressurized if desired. With embodiments of the present invention, even deep wells are capable of adequate well control without exceeding formation fracture pressure.

The embodiments of the present invention shown and described above allow greater flexibility in choosing drilling fluid systems while maintaining well control and minimizing formation damage. Also, embodiments facilitate a tailored wellbore pressure profile from the top to the bottom of the wellbore and at any portion in between which is maintainable for a period of time.

The tailored wellbore pressure profile could involve tailoring the flow behavior of foam used as drilling fluid at any or all depths of the wellbore to maximize cuttings-carrying capacity of the foam. The tailored wellbore pressure profile could include maintaining a substantially homogenous foam flow regime in the annulus. Fluid properties of the foam, including apparent shear strength, viscosity, and foam quality, may be maintained within the annulus to obtain consistency and uniformity in the transport of solid materials within the foam. Exemplary base liquids which may be utilized in the foam include water, hydrocarbons, oil, acid, water/hydrocarbon mixtures, combinations of any of the above liquids, or any other liquid. Examples of gases which may be included in the foam are nitrogen ($N_2$) and carbon dioxide ($CO_2$), air, natural gas, mixtures of gases, or any other compressible gas. Preferably, water is used as the liquid, and $N_2$, $CO_2$, air, or a combination of $N_2$ and $CO_2$ is used as the gas.

Figure 15:
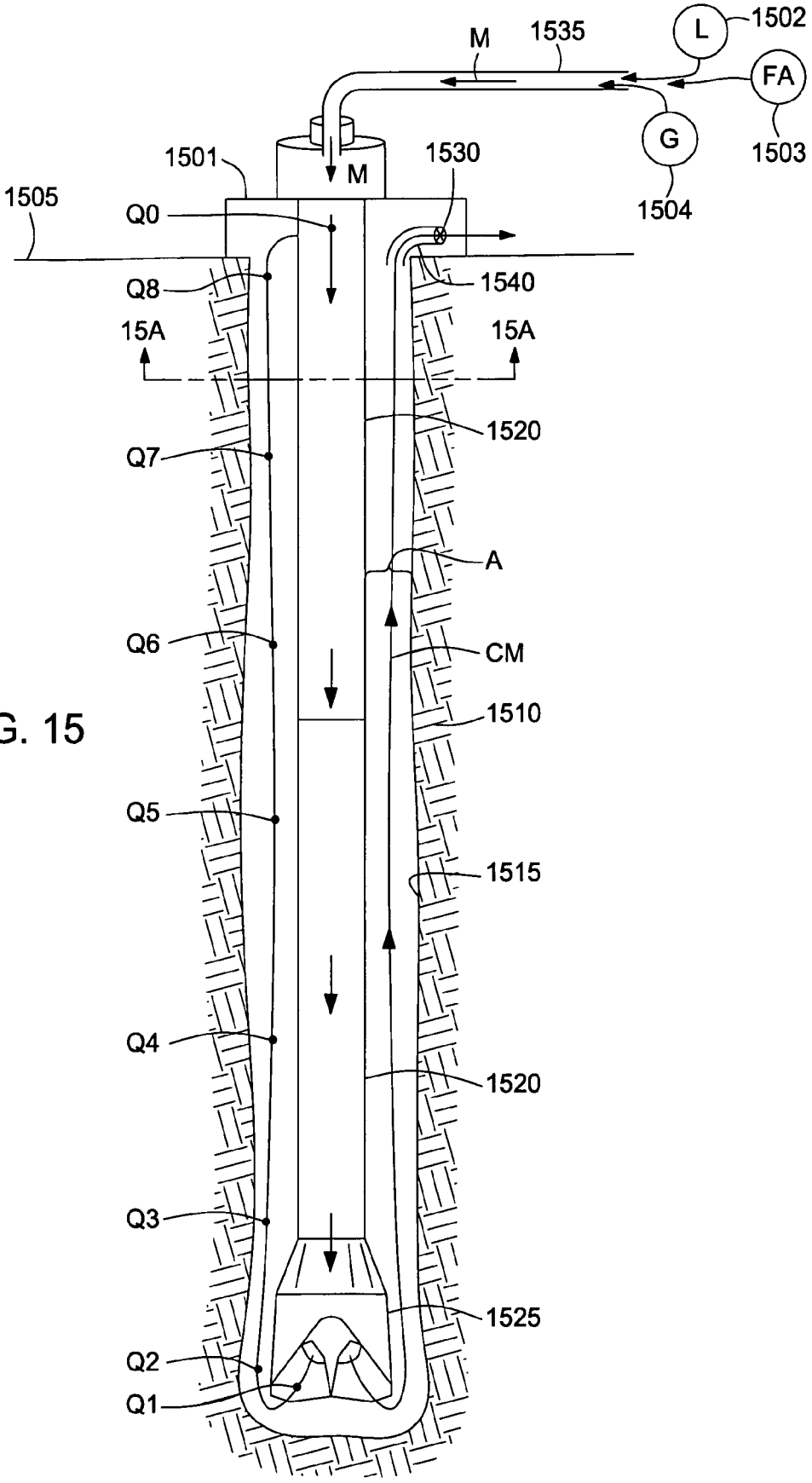
FIG. 15 is a sectional view of a drilling fluid application using foam with a pressure control apparatus. The foam flow properties are controllable by the pressure control apparatus along the depth of the annulus existing between an outer diameter of a drill string and a wall of the wellbore.

FIG. 15 shows a foam M used as the drilling fluid when utilizing a drill string 1520 to form a wellbore 1515 in a formation 1510. A liquid stream L, gas stream G, and foaming agent stream FA which are combined to form the foam M are shown at a surface 1505 of the wellbore 1515. The foaming agent stream FA may include a foaming agent or a gelling agent. The foaming agent may be used in any quantity, but preferably comprises approximately 0.5% to approximately 1% of the liquid volume of the foam M. The liquid stream L has an associated injection pump 1502, the gas stream G has an associated injection pump 1504, and the foaming agent stream FA has an associated injection pump 1503. The streams L, G, and FA form the foam M which travels through a pipe 1535 inserted into a wellhead 1501 disposed at the surface 1505.

The drill string 1520 includes an earth removal member, preferably a drill bit 1525, operatively connected to its lower end. A pipe 1540 conveys foam M exiting an annulus A between the outer diameter of the drill string 1520 and the wellbore 1515 wall. The pipe 1540 may have a surface choke 1530 therein for selectively pressurizing the foam M flowing up through the annulus A, as described below.

In operation, foam M is introduced into the wellbore 1515 as drilling fluid in a drilling operation. To form the foam M, the liquid stream L, gas stream G, and foaming agent stream FA are introduced into the pipe 1535. Each stream L, G, and FA may be pumped into the pipe 1535 by the injection pumps 1502, 1504, and 1503, respectively. FIG. 15 shows a preferred embodiment wherein the streams L, G, and FA are pumped into the pipe 1535 substantially parallel to one another and mix together at approximately the same time. In other embodiments, the liquid stream L may be pumped into gas stream G and foaming agent stream FA pumped into the L/G mixture thereafter, the mixture of stream G and stream FA may be pumped into stream L, or the mixture of stream L and stream FA may be pumped into stream G. Any other order of mixing of the streams L, G, and FA to eventually form the foam M is contemplated in other embodiments of the present invention. In any event, foam M is generated upon contact of the constituents L, G, and FA.

The foam M is introduced into a longitudinal bore of the drill string 1520 from the surface 1505 while the drill string 1520 is lowered into the formation 1510 to form the wellbore 1515. The foam M travels downward through the bore of the drill string 1520, out one or more perforations through the drill bit 1525, and up through the annulus A to the surface 1505. At some time after the foam M exits the drill bit 1525, cuttings resulting from drilling into the formation 1510 enter the foam M and form a mixture stream CM in which the cuttings are carried by the foam M to the surface 1505 during drilling. The foam M carries the cuttings produced from the formation 1510 out of the wellbore 1515 to the surface 1505. After the mixture stream CM exits the annulus A, the foam M may then be recycled back into the bore of the drill string 1520 for further use during drilling. Before recycling the foam M back into the drill string 1520, the flow behavior of the foam M may be altered by pressurizing the foam M or by introducing more liquid L, gas G, or foaming agent FA into the foam M. Additionally, before recycling the foam M into the drill string 1520, the cuttings may be separated from the foam M.

Figure 15A:
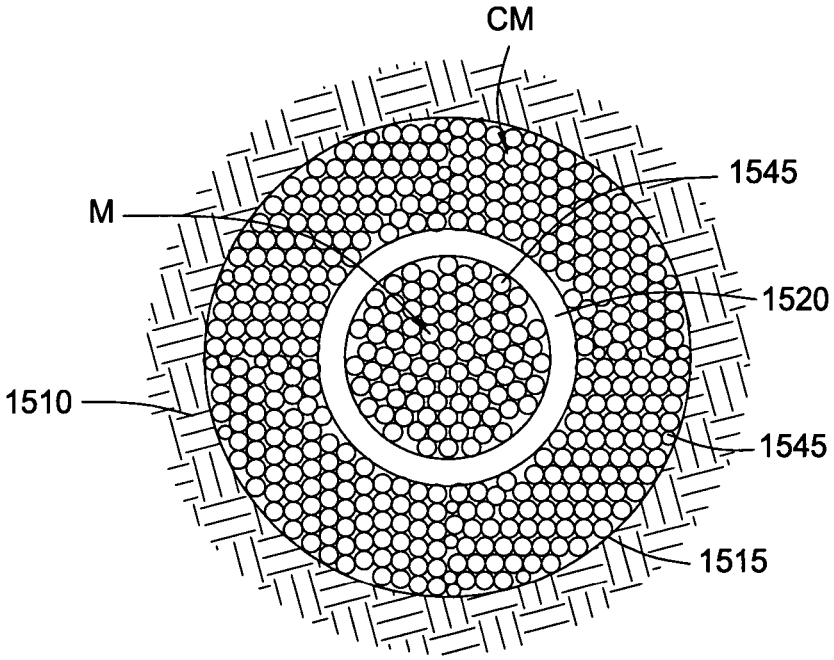
FIG. 15A is a cross-sectional view of the drill string within the wellbore along line 15A-15A of FIG. 15.

FIG. 15A, which is a downward cross-sectional view along line 15A-15A of FIG. 15, shows the foam M within the bore of the drill string 1520 as well as the foam/cuttings mixture stream CM within the annulus A. The foam M and the mixture stream CM include multiple gas bubbles 1545 in close contact with one another, preferably all touching one another so that cuttings are not dropped back into the wellbore 1515 by falling through the stream CM in between the bubbles 1545. The stability of the foam M or the closeness of the bubbles 1545 to one another may be increased by adding higher quantities of foaming agent FA into the foam stream M. As the foam quality varies, the average bubble size, range of bubble sizes, and the bubble distribution within the base liquid vary. In one embodiment, the bubbles 1545 may include super-stable bubbles such as aphrons, as described in the article "Aphron-based Drilling Fluid: Novel Technology for Drilling Depleted Formations" by White, Chesteres, Ivan, Maikranz, and Nouris published in the October 2003 issue of *World Oil*, which article is incorporated herein by reference in its entirety.

At any point in the drilling operation, the stability of the foam M may be altered by increasing or decreasing the foaming agent FA quantity introduced into the foam M at the surface 1505. Also adjustable during the drilling operation is the pressure of the foam M within the annulus A by the surface choke 1530 or another pressure control mechanism. If it is desired to increase the pressure of the foam M within the annulus A, the surface choke 1530 can choke off the flow of the foam/cuttings mixture stream CM at the surface to induce a back-pressure within the annulus A to maintain a pressure profile along the annulus A. Additionally or in the alternative, any of the pressure control devices shown and described in FIGS. 1-14 above, alone or in combination with one another, may be used to dynamically control pressure of the foam M and the mixture stream CM within the wellbore 1515, especially within the annulus A, at all desired locations at all desired depths within the wellbore 1515. The choke 1530 may operate automatically, allowing automatic pressure regulation under all conditions, and may be computer-controlled.

Because the pressure may be maintained along the entire annulus A, cuttings-carrying capacity of the foam M may be maintained throughout the travel of the mixture stream CM from the wellbore 1515 up to the surface 1505. Dynamic pressure control of the foam M within the annulus A allows the flow behavior of the foam M to be controlled along the annulus A to thereby maintain control of the cuttings-carrying capacity of the foam M.

Foam quality is the ratio of gas volume to foam volume at a given pressure and temperature. At a given pressure and temperature, foam quality may be calculated according to the following equation:

$$FQ = \frac{V_g}{V_f} = \frac{V_g}{V_l + V_g},$$

where FQ is foam quality, $V_f$ is the volume of the foam, $V_l$ is the volume of the liquid in the foam, and $V_g$ is the volume of gas in the foam. Foam only exists within certain foam quality values. To maintain foam, foam quality is maintained in the range of approximately 0.52 to approximately 0.96. Preferably, to maintain cuttings-carrying capacity in the annulus A, foam quality is maintained in the range of approximately 0.52 to approximately 0.95. More preferably, foam quality is maintained in the range of approximately 0.64 to approximately 0.95 along the annulus A. Even more preferably, foam quality is maintained in the range of approximately 0.64 to approximately 0.92 along the annulus A. The lower limit of 0.52 exists because the gas bubbles in foam usually do not touch each other below this foam quality. Similarly, the upper limit of 0.96 exists because above 0.96 foam quality, the foam usually generates into a mist. To maintain a foam with known fluid flow properties, standpipe pressure (the pressure of the foam as it travels down through the drill string plus the friction-added opposing pressure due to the drill pipe), annulus A pressure, and the volume of the gas being pumped are the values needed. The gas feed rate and the pressure may be adjusted to obtain the desired foam quality along the annulus A.

Because pressure can be dynamically manipulated to a given value within the annulus A by one or more pressure control devices shown and described above, the following equation may be used to determine the volume of the foam needed to obtain a given foam quality along the annulus A (at a known temperature) when turbulent flow conditions exist in the annulus A:

$$V_f = \sqrt{\left[\frac{25.8(d_o - d_i)}{f\rho}\right]\left[\frac{\Delta P}{\Delta L} + G_h(1 - FQ)\right]},$$

where $V_f$ is the volume of the foam, $d_o$ is the inner diameter of the surrounding casing or wellbore into which the drill string is run (in inches), $d_i$ is the outer diameter of the drill string (in inches), FQ is foam quality, f is the fanning friction factor, p is the foam density (in ppg), ΔP/ΔL is the combined pressure loss of the fluid due to friction of flow through the drill string and hydrostatic pressure loss due to depth of the fluid within the wellbore (in psi/ft), and $G_h$ is the hydrostatic gradient of the base liquid (in psi/ft). ΔP/ΔL is the change in pressure over the length of the drill string in the annulus A, or (P2−P1)/(L2−L1), wherein P2 is the pressure of the foam at the depth position L2 in the annulus A and P1 is the pressure of the foam at the depth position L1 in the annulus A.

Similarly, the following equation may be used to determine the volume of the foam needed to obtain a given foam quality along the drill string and annulus A (at a known temperature) when turbulent flow conditions exist in the drill string:

$$V_f = \sqrt{\left[\frac{25.8(d)}{f\rho}\right]\left[\frac{\Delta P}{\Delta L} + G_h(1 - FQ)\right]},$$

where the letters and symbols of the equation represent the same parameters as stated above with regards to the volume of the foam needed to obtain a foam quality when turbulent flow conditions exist in the annulus A. The new parameter d of the above equation represents the diameter of the drill string in inches.

The relationship between pressure and volume of a confined gas is defined by Avogadro's law, which is as follows:

$$PV = nRT,$$

where P is pressure of the gas, V is volume of the gas, n is moles of the gas, R is a gas constant, and T is temperature of the gas. Temperature of the foam is measurable within the annulus, so temperature is a known value. Avogadro's law may be used to determine volumetric changes in the gas phase as the temperature and pressure change. The temperature and pressure have known values due to the pressure control mechanism and the ability to measure temperature within the annulus A. The gas volume of the foam M is assumed to behave according to the ideal gas law, or Boyle's law, where the pressure of the gas multiplied times the volume of the gas is constant for a given mass at a constant temperature (Boyle's law may be derived from Avogadro's law when moles of gas and temperature of the gas are constant).

The gas-phase volume ($V_g$) of foam varies considerably as a function of pressure, causing foam quality, velocity, and viscosity to vary considerably as a function of pressure. By using the above equations and other equations listed and described in the foam manual having the author of Smith, which is herein incorporated by reference in its entirety, the foam quality at various intervals within the annulus A, represented by Q1 through Q7, may be accurately achieved by manipulating the pressure within the annulus A using the pressure control mechanism(s), as shown in FIG. 15. Q0 represents foam quality at the surface 1505. Also, the shear strength and viscosity of the foam may be achieved at points Q0 through Q7 by manipulating the pressure within the wellbore 1515 using the pressure control mechanism(s). The calculations may be performed by a computer programmed with the equations to determine the pressure which the pressure control mechanism(s) should achieve within the annulus A, and the pressure control mechanism may then be operated accordingly. By managing the flow properties of the foam by managing the pressure within the annulus A, cuttings removal ability is maintained throughout the annulus A.

In an additional embodiment, managed wellbore pressure concepts as described above are utilized to maintain pressure within the wellbore during cementing of a tubular body such as a casing string or casing section within the wellbore. Using foamed cement to set the casing within the wellbore is described in the book "Well Cementing" having the editor Erik B. Nelson at pages C-14 to C-18, which is incorporated by reference herein. A good foamed cement job requires constant density in which several stages of foamed cement, each with a constant ratio of nitrogen or air, are used. Nitrogen ratios are calculated with the intention that each stage has the same average density at its final position in the annulus.

Unfortunately, in the current method of calculating the density, each stage does not have its same average density at its final position in the annulus because of varying hydrostatic pressure within the annulus between the casing and the wellbore wall. The quality of the first stages of foamed cement is typically low at greater depths because of compression of the gas; therefore, the density of the first stages of cement as they pass the cement shoe is higher than the density of subsequent cement stages. Attempts to alleviate this result have taken the form of surface calculations of a foamed cement job requiring estimates of hydrostatic pressure within the annulus, where hydrostatic pressure within the annulus was essentially a parameter which was not easily alterable to a known value.

Because of the managed pressure drilling concepts described above, hydrostatic pressure within the annulus is now changeable to obtain a desired density of the foamed cement at various depths and maximize the quality of the cementing job. The desired density of cement at each depth may be attained by calculating the hydrostatic pressure within the annulus for each stage of cement, using the equations set forth in "Well Cementing," above incorporated by reference, to render the desired density of cement when the concentration of the components within the cement is a given parameter. The hydrostatic pressure within the annulus is then accomplished by altering the pressure within the annulus using one or more of the pressure management mechanisms shown and described above in relation to FIGS. 1-15A.

While the foregoing is directed to embodiments of the present invention, other and further embodiments of the invention may be devised without departing from the basic scope thereof, and the scope thereof is determined by the claims that follow.

The excerpt from the Smith Foam Manual at paragraphs [0190]-[0267] and pgs. 24-28 of US Pub. No. 2006/0157282 is herein incorporated by reference and may be used with one or more embodiments of the present invention.

The invention claimed is:

1. A method for drilling a wellbore, comprising:

drilling the wellbore by injecting drilling fluid through a drill string disposed in the wellbore and rotating a drill bit, wherein:

the drilling fluid exits the drill bit and carries cuttings from the drill bit, the drilling fluid and cuttings (returns) flow to a surface of the wellbore through an annulus formed between the drill string and the wellbore, the drill string comprises:

a tubular body having a longitudinal bore therethrough, and the drill bit operatively coupled to a lower end of the tubular body, at least a portion of the wellbore is lined with casing, a pressure sensor is disposed in the casing at a location in the wellbore, and the pressure sensor is in communication with the surface via a cable;

simultaneously while drilling, measuring an annulus pressure using the pressure sensor;

simultaneously while drilling, transmitting the measured annulus pressure to the surface in real time via the cable; and simultaneously while drilling, controlling a bottomhole pressure adjacent a formation using the measured annulus pressure by selectively adjusting a variable choke, thereby exerting a backpressure on the returns so that the bottomhole pressure is equal to or substantially equal to a pore pressure of the formation, wherein the choke is disposed in the wellbore.

2. The method of claim 1, wherein:

the drill string further comprises the variable choke longitudinally coupled to the body so that the choke is lowered down the wellbore with the body during drilling, and at least a portion of the returns flow through the choke.

3. The method of claim 2, wherein the choke comprises:

a body having a bore therethrough, and a seal engaged with the choke body and the casing, the seal diverting the returns from the annulus and through the choke bore.

4. The method of claim 3, wherein:

a mechanical seal is disposed between the choke body and the drill string, thereby sealing an interface therebetween.

5. The method of claim 2, wherein:

the body comprises joints of wired drill pipe, and the choke is in communication with the surface via the wired drill pipe.

6. A method for drilling a wellbore, comprising:

drilling the wellbore by injecting drilling fluid through a drill string disposed in the wellbore and rotating a drill bit, wherein:

the drilling fluid exits the drill bit and carries cuttings from the drill bit, the drilling fluid and cuttings (returns) flow to a surface of the wellbore through an annulus formed between the drill string and the wellbore, the drill string comprises:

a tubular body having a longitudinal bore therethrough, and the drill bit operatively coupled to a lower end of the tubular body, at least a portion of the wellbore is lined with casing, a pressure sensor is disposed in the casing at a location in the wellbore, and the pressure sensor is in communication with the surface via a cable;

simultaneously while drilling, measuring an annulus pressure using the pressure sensor;

simultaneously while drilling, transmitting the measured annulus pressure to the surface in real time via the cable; and simultaneously while drilling, controlling a bottomhole pressure adjacent a formation using the measured annulus pressure by selectively adjusting a variable choke, thereby exerting a backpressure on the returns so that the bottomhole pressure is equal to or substantially equal to a pore pressure of the formation, wherein:

the body comprises joints of drill pipe, and the method further comprises making up or breaking out a joint of drill pipe with/from the body, the drill string further comprises the variable choke longitudinally coupled to the body so that the choke is lowered down the wellbore with the body during drilling, at least a portion of the returns flow through the choke, and the method further comprises maintaining the bottomhole pressure while making up or breaking out by closing the choke.

7. A method for drilling a wellbore, comprising:

drilling the wellbore by injecting drilling fluid through a drill string disposed in the wellbore and rotating a drill bit, wherein:

the drilling fluid exits the drill bit and carries cuttings from the drill bit, the drilling fluid and cuttings (returns) flow to a surface of the wellbore through an annulus formed between the drill string and the wellbore, the drill string comprises:

a tubular body having a longitudinal bore therethrough, and the drill bit operatively coupled to a lower end of the tubular body, at least a portion of the wellbore is lined with casing, a pressure sensor is disposed in the casing at a location in the wellbore, and the pressure sensor is in communication with the surface via a cable;

simultaneously while drilling, measuring a first annulus pressure using the pressure sensor;

simultaneously while drilling, transmitting the measured first annulus pressure to the surface in real time via the cable; and simultaneously while drilling, controlling a second annulus pressure adjacent a formation using the measured first annulus pressure by selectively adjusting a variable choke disposed in the wellbore, thereby exerting a backpressure on the returns so that the second annulus pressure is substantially equal to a pore pressure of the formation.

8. A method for drilling a wellbore, comprising:

drilling the wellbore by injecting drilling fluid through a drill string disposed in the wellbore and rotating a drill bit, wherein:

the drilling fluid exits the drill bit and carries cuttings from the drill bit, the drilling fluid and cuttings (returns) flow to a surface of the wellbore through an annulus formed between the drill string and the wellbore, the drill string comprises:

a tubular body having a longitudinal bore therethrough, the drill bit operatively coupled to a lower end of the tubular body, and a variable choke longitudinally coupled to the body so that the choke is lowered down the wellbore with the body during drilling the body comprises joints of drill pipe, at least a portion of the returns flow through the choke, at least a portion of the wellbore is lined with casing, a pressure sensor is disposed in the casing at a location in the wellbore, and the pressure sensor is in communication with the surface via a cable;

simultaneously while drilling, measuring a first annulus pressure using the pressure sensor;

simultaneously while drilling, transmitting the measured first annulus pressure to the surface in real time via the cable;

simultaneously while drilling, controlling a second annulus pressure adjacent a formation using the measured first annulus pressure by selectively adjusting the variable choke, thereby exerting a backpressure on the returns so that the second annulus pressure is substantially equal to a pore pressure of the formation;

making up or breaking out a joint of drill pipe with/from the body; and maintaining the second annulus pressure while making up or breaking out by closing the choke.

* * * * *